US005960501A

United States Patent [19]

Burdick

[11] Patent Number: 5,960,501

[45] Date of Patent: Oct. 5, 1999

[54] OZONATED LAUNDRY SYSTEM WITH WATER RE-USE CAPABILITY

[75] Inventor: Alan Burdick, Charlotte, N.C.

[73] Assignee: Envirocleanse Systems, Inc., Mooresville, N.C.

[21] Appl. No.: 09/233,246

[22] Filed: Jan. 19, 1999

Related U.S. Application Data

[63] Continuation-in-part of application No. 09/153,515, Sep. 15, 1998.

[51] Int. Cl.[6] ..... D06F 33/02; D06F 39/00

[52] U.S. Cl. ..... 8/158; 68/12.12; 68/13 R; 68/18 F; 68/183; 68/207; 68/208; 68/902

[58] Field of Search ..... 8/158; 68/12.01, 68/12.12, 12.18, 13 R, 18 F, 183, 207, 208, 902; 422/186.09, 186.12

[56] References Cited

U.S. PATENT DOCUMENTS

| | | | |
|---|---|---|---|
| 4,696,739 | 9/1987 | Pedneault . | |
| 5,097,556 | 3/1992 | Engel . | |
| 5,181,399 | 1/1993 | Engel . | |
| 5,241,720 | 9/1993 | Engel . | |
| 5,404,732 | 4/1995 | Kim | 422/186.12 X |
| 5,493,743 | 2/1996 | Schneider . | |
| 5,625,915 | 5/1997 | Radler et al. | 68/12.12 X |
| 5,806,120 | 9/1998 | McEachern . | |

*Primary Examiner*—Philip R. Coe

*Attorney, Agent, or Firm*—Christopher C. Dremann PC; Christopher C. Dremann

[57] ABSTRACT

A system and method for treating laundry with ozone is provided including a controller that receives a load signal based on a wash load selection. In response to the load signal, the controller transmits a power supply control signal to a variable power supply to vary an output potential to an ozone generator. The controller transmits a dryer control signal to an air dryer to provide desiccated air to the ozone generator. The controller transmits a sparging pump control signal to a sparging pump to pump the ozone generated by the ozone generator to a sparging rod adjacent the drain of a laundry machine where the ozone is dispersed directly into the wash liquor. In a preferred embodiment, an adapter removably secures the sparging rod to the wall of the laundry machine so that the sparging rod may be readily removed for cleaning, repair or replacement. In an alternative embodiment, ozone from the ozone generator is also entrained into the wash liquor by a venturi positioned in a side arm recirculation assembly as the wash liquor is returned to the laundry machine for further use in the wash process. Regardless, the concentration of the ozone dispersed directly into the wash liquor, or dispersed and/or entrained into the wash liquor, can be varied in response to the wash load. In addition, the wash chemistry can be balanced with the ozone to minimize ozone off-gassing and to conserve energy and water. A system and method for treating laundry with ozone is also provided which includes the capability to re-use at least a portion of the water from the municipal water supply utilized by the laundry machine during the wash process to further conserve energy and water.

11 Claims, 14 Drawing Sheets

FIG. 5

| 90 STEP NUMBER | 92 NAME | 94 WATER HOT | 94 WATER COLD | 96 WATER LEVEL | 98 MIN. | 100 CHEM NUM. |
|---|---|---|---|---|---|---|
| 1 | BREAK/BLEACH | ✓ | ✓ | 3 | 11 | 1,2,3 |
| | DRAIN | | | | 1 | |
| 2 | INTERMEDIATE EXTRACTION | | | | 1 | |
| 3 | RINSE | ✓ | ✓ | 3 | 2 | |
| | DRAIN | | | | 1 | |
| 4 | INTERMEDIATE EXTRACTION | | | | 1 | |
| 5 | RINSE/SOUR | | ✓ | 3 | 4 | 4 |
| | DRAIN | | | | 1 | |
| 6 | FINAL EXTRACTION | | | | 8 | |
| 7 | FINAL DRAIN | | | | | |

FIG. 6
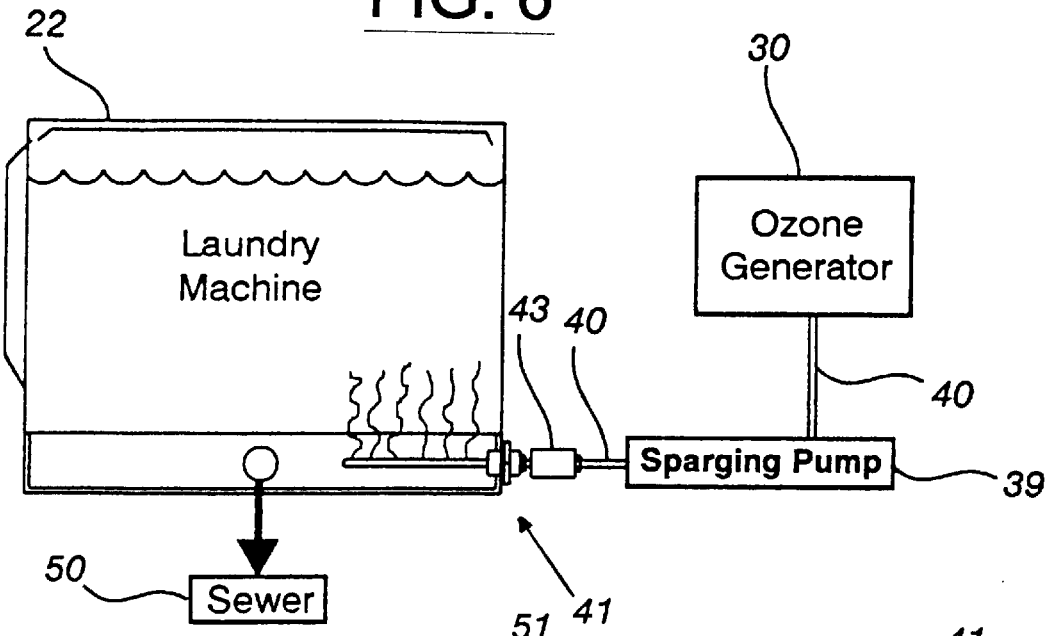
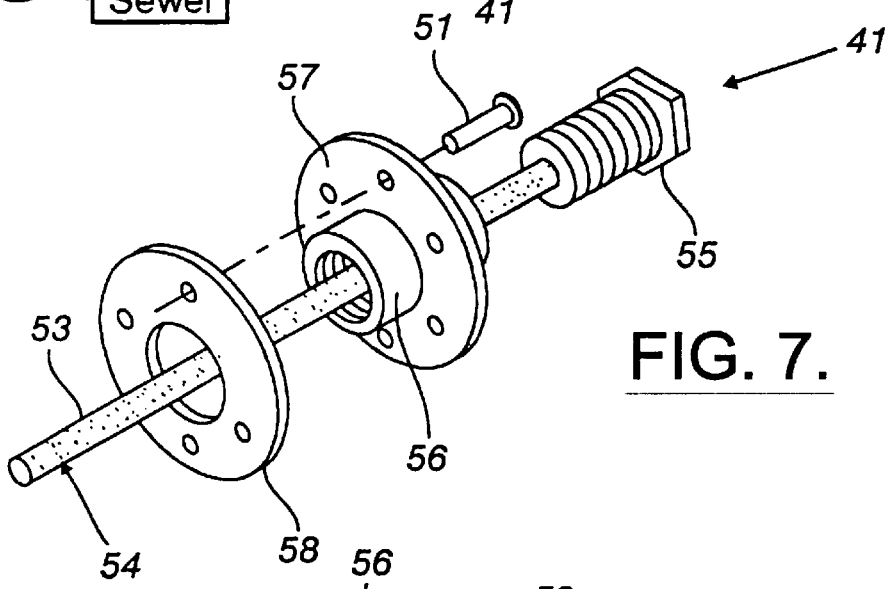
FIG. 7.
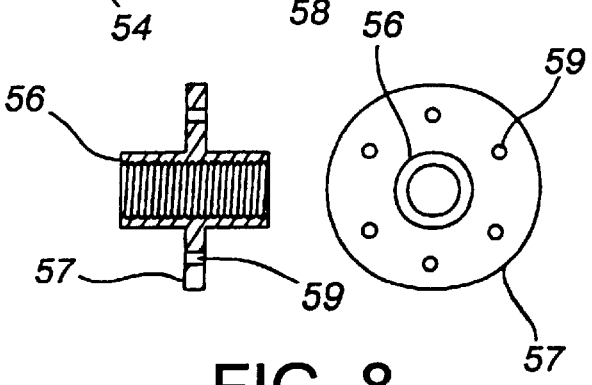
FIG. 8.

OZONATED LAUNDRY SYSTEM WITH WATER RE-USE CAPABILITY

CROSS REFERENCE TO RELATED APPLICATIONS

This application is a continuation-in-part of co-pending U.S. patent application Ser. No. 09/153,515 filed Sep. 15, 1998.

FIELD OF THE INVENTION

The invention relates generally to a system and method for treating laundry with ozone by varying the concentration of the ozone in the wash liquor in response to the wash load. More particularly, the invention relates to a system and method for treating laundry with ozone including an adapter for removably securing a sparging rod adjacent the drain of the laundry machine. In addition, the ozonated laundry system and method includes the capability to re-use at least a portion of the water utilized by the laundry machine during the wash process.

BACKGROUND OF THE INVENTION

The utilization of activated oxygen, or ozone, to clean, disinfect and deodorize is well known. Ozone is created when oxygen comes in contact with either ultraviolet light or electricity. The ultraviolet light or electricity breaks apart some of the oxygen molecules, each of which consists of a pair of oxygen atoms held together by covalent bonds, into a number of singular oxygen atoms. A portion of the number of singular oxygen atoms thereafter reassemble to form ozone ($O_3$) molecules. The ozone molecules have very high oxidation capabilities, and thus, readily react with metals to form oxides, such as $FeO_2$ and $CrO_2$.

For many years, water treatment plants have positioned ozone generators in the wastewater, or effluent, stream to introduce ozone into the effluent. The ozone kills bacteria and inactivates many viruses, fungi and other pathogens present in the effluent. More recently, producers of bottled water have incorporated ozone in the purification process to kill germs and bacteria that might be present in the water. It is also well known to treat laundry with ozone. U.S. Pat. No. 5,097,556 issued Mar. 24, 1992, U.S. Pat. No. 5,181,399 issued Jan. 26, 1993 and U.S. Pat. No. 5,241,720 issued Sep. 7, 1993, all to Engle et al.; and U.S. Pat. No. 5,493,743 issued Feb. 27, 1996 to Schneider et al., each disclose methods and apparatus for utilizing ozone in the laundry wash process to treat laundry wastewater.

The use of ozone in the laundry wash process produces a number of significant environmental benefits and cost savings. For example, when ozone is generated and introduced into the wash liquor during the wash cycle, the activated oxygen attacks the larger soil molecules and fragments them into smaller soil molecules that are more easily acted on by the components of the wash chemistry (e.g., detergents, bleaches, additives and surfactants). Thus, the wash chemistry is more effective in removing the soil from the laundry items. As a result, a greater percentage of the soil embedded in the laundry items dissolves into the wash liquor and is extracted with the laundry wastewater. In addition, the strong oxidizing capabilities of ozone act as a powerful disinfecting and cleansing additive for inactivating contaminants, such as viruses and other pathogens.

Because of the increased effectiveness of the wash chemistry and the oxidizing capabilities of the ozone, the concentration of the wash chemistry in the wash liquor can be substantially reduced. In some applications, the wash chemistry can even be eliminated entirely. Accordingly, fewer chemicals that are harmful to the environment are required to be used and subsequently discharged into the ground or municipal sewer system. The increased effectiveness of the wash chemistry shortens the wash cycle time of the laundry, thereby reducing the amount of energy used by the laundry. The number of rinse cycles and the average rinse cycle time can also be reduced because fewer chemicals must be rinsed and extracted from the laundry items. As a result, the total amount of water needed to extract the soil and wash chemistry from the laundry is reduced. An added benefit of the reduced concentration of wash chemistry, wash and rinse cycle times and number of rinse cycles is that the useful life of the laundry items washed in an ozonated laundry system is increased.

With fewer chemicals present in the wash liquor, the wastewater from the laundry process is less harmful to the environment, and is easier and less costly to treat. Sewage costs have risen dramatically in recent years in response to ever increasing water purification standards. The stricter municipal water purification standards require wastewater, especially from commercial and industrial sources, to be thoroughly treated before the water is returned to the municipal water supply. In some instances, ozone can be utilized in a closed loop laundry machine to treat the laundry wastewater after filtration. The filtered and ozone treated water is then recycled back to the wash liquor for further use by the laundry machine. Accordingly, additional cost savings and environmental benefits are obtained.

For example, ozone has been applied to closed-loop laundry systems (FIG. 1*a*) which have the capability to recycle the water after each cycle of the wash process. A storage tank 10 is filled with water supplied from a municipal water source in a conventional manner and is re-filled when the water level in the storage tank 10 is low. Ozone generated by an ozone generator 12 is introduced into the water, for example, by pumps or injectors located in the storage tank 10. The laundry machine 14 is then filled with ozonated water at the start of the wash process. During a drain cycle of the wash process, the wash liquor is drained from the laundry machine 14 through filter 16 to collect particulate waste. One or more filters or filter screens can be used to progressively eliminate smaller particles without impeding the flow of the wash liquor. The filtered wash liquor is then diverted to the sewer 18 for further wastewater treatment, for example after a wash cycle, or returned to the storage tank 10 to be re-used, for example after a rinse cycle, thereby creating a closed-loop laundry system. After the wash process has completed a final drain cycle, the filtered wastewater can be diverted to the sewer 18 or returned to the storage tank 10 for re-use.

Ozone has also been applied to open-loop laundry systems (FIG. 1*b*) which drain and divert the laundry wastewater to the sewer 18 after each wash cycle and after each rinse cycle of the wash process. A storage tank 10 is filled with water supplied from a municipal water source in a conventional manner and is re-filled after each cycle of the wash process. Ozone generated by an ozone generator 12 is introduced into the water, for example, by pumps or injectors located in the storage tank 10. The laundry machine 14 is then filled with ozonated water at the start of the wash process. During a drain cycle of the wash process, the wash liquor is drained from the laundry machine 14 through filter 16 to collect particulate waste. At the end of each cycle of the wash process, the wash liquor is drained, filtered and diverted to the sewer 18 for further wastewater treatment before rejoining the municipal water supply, thereby creating an open-loop laundry system.

Unfortunately, utilization of ozone in laundry systems typically produces off-gases because the concentration of ozone introduced into the laundry wash liquor is maintained at a constant level regardless of the size or content of the particular wash load. In commercial and institutional laundry facilities, various sizes of wash loads and various laundry items are washed. However, as previously mentioned, the concentration of ozone introduced into each wash process is maintained at a constant level. Once the ozonated water is introduced into the laundry machine, agitation of the wash liquor causes the excess ozone to off-gas. Because the size and content of wash loads vary widely in commercial applications, off-gassing occurs whenever a constant level of ozone is introduced into the wash liquor during the wash process. The size and content of the wash load determines the amount of water and wash chemistry needed to clean the laundry, and as a result, the concentration of the wash chemistry in the wash liquor. The constant level of ozone produced by the prior art ozonated laundry systems does not take into account the size and content of the wash load, and thus, the concentration of the wash chemistry in the wash liquor. As a result, off-gassing is certain to occur.

It is also unfortunate that ozone molecules have a tendency to degenerate over time and revert to oxygen molecules and singular oxygen atoms. Accordingly, whenever possible it is preferable to introduce ozone directly into the wash liquor in the laundry machine during the wash process to maximize the benefit provided by the ozone. A number of difficulties, however, are typically encountered when ozone is introduced directly into the wash liquor in the laundry machine. In particular, a secure, fluid-tight connection must be maintained between the injector utilized to introduce the ozone into the wash liquor and the laundry machine to prevent leakage of the untreated wash liquor into the environment outside the laundry machine. However, at the same time it is desirable that the injector be accessible and easily removed for cleaning, repair or replacement. Ozone injectors, and in particular elongate ozone diffuser stones or sparging rods, have previously been inserted through and welded to a wall adjacent the drain of the laundry machine. Oftentimes, however, access to the laundry machine with cumbersome welding equipment is limited. Further, once welded the ozone injector is permanently fixed to the wall of the laundry machine and cannot be readily removed for cleaning, repair or replacement. Still further, welding often causes the metal in the area of the wall of the drain of the laundry machine to weaken, thus increasing the risk that the laundry machine will leak or rupture under the hydrostatic and hydrodynamic forces generated by the laundry machine during the wash process.

As previously discussed, the concentration of the wash chemistry in the wash liquor can be reduced by the addition of ozone. However, current open-loop laundry systems that utilize ozone do not adequately address the opportunity for further reduction of the wash chemistry, energy and water in response to wash loads that vary in size and content. Despite the benefits of using ozone in the laundry wash process, more efficient use of the wash chemistry and further reduction in energy and water consumption are possible. The additional benefits of using less wash chemistry and consuming less energy and water for washing and rinsing laundry are substantial, especially in existing commercial and institutional laundry facilities that wash large quantities of laundry. The open-loop, ozonated laundry systems utilized in existing commercial and institutional laundry facilities, however, are not readily converted to closed-loop, ozonated laundry systems. Such facilities typically utilize a common collection pit, or sump, for collecting and temporarily storing the wastewater drained from one or more laundry machines during a drain cycle as it is filtered and diverted to the sewer. As previously mentioned, closed-loop, ozonated laundry systems divert the wastewater leaving the laundry machine through a particulate filter directly into a storage tank. Heretofore, none of the prior art closed-loop, ozonated laundry systems have been designed to collect the wastewater from one or more laundry machines in a conventional sump, filter and return the wastewater directly to the laundry machines for re-use.

It is therefore apparent that a system and method for treating laundry with ozone is needed that varies the concentration of the ozone in the wash liquor in response to the wash load. Further needed is a system and method for treating laundry with ozone that varies the concentration of the ozone in the wash liquor in response to the size and content of the wash load. Further needed is a system and method for treating laundry with ozone that determines the minimum amount of wash chemistry required and the optimum amount of ozone to be introduced into the wash liquor for various wash loads, thereby reducing ozone off-gassing and further reducing the amount of energy and water consumed to wash and rinse the laundry items. Further needed is a system and method for treating laundry with ozone that includes an adapter for removably securing an ozone injector adjacent the drain of the laundry machine. Still further needed is an ozonated laundry system having the capability to re-use at least a portion of the water from the municipal water supply utilized by the laundry machine during the wash process.

OBJECTS OF THE INVENTION

Thus, the principle object of the invention is to provide a system and method for treating laundry with ozone that varies the concentration of the ozone in the wash liquor in response to the wash load.

Another, more particular, object of the invention is to provide a system and method for treating laundry with ozone that varies the concentration of the ozone introduced into the wash liquor in response to the size and content of the wash load.

Another, more particular, object of the invention is to provide a system and method for treating laundry with ozone that balances the wash chemistry with the concentration of the ozone introduced into the wash liquor in response to the wash load.

Another, more particular, object of the invention is to provide a system and method for treating laundry with ozone that determines the minimum amount of wash chemistry required and the optimum amount of ozone to be introduced into the wash liquor for various wash loads, thereby reducing ozone off-gassing and further reducing the amount of energy and water consumed to wash and rinse the laundry items.

Another, more particular, object of the invention is to provide a system and method for treating laundry with ozone that includes an adapter for removably securing an ozone injector adjacent the drain of the laundry machine.

Another, more particular, object of the invention is to provide an ozonated laundry system that includes the capability to re-use at least a portion of the water from the municipal water supply that is utilized by the laundry machine during the wash process.

SUMMARY OF THE INVENTION

The present invention is a system and method for treating laundry with ozone that varies the concentration of ozone introduced into the wash liquor in response to the wash load. A user selects a predetermined wash formula corresponding to the size and content of the wash load. In response to the predetermined wash formula, a controller sends a control signal to a power supply in electrical communication with the controller. The power supply produces a variable electrical output potential in response to the control signal that is in turn provided to an ozone generator in electrical communication with the power supply. At the same time, an air dryer previously activated by the controller supplies desiccated air to the ozone generator. Accordingly, the ozone generator generates a variable amount of ozone corresponding to the electrical output potential received from the power supply. The ozone is then pumped to an injector assembly for dispersing the ozone directly into the wash liquor in the laundry machine during the wash process. The injector assembly includes an ozone injector, which is preferably an ozone diffuser stone or sparging rod, and an adapter for removably securing the ozone injector adjacent the drain of the laundry machine.

In an alternative embodiment, the laundry machine further includes a side arm recirculation assembly. In the alternative embodiment, the controller sends a control signal to a process pump at appropriate times during the wash process. Once activated by the controller, the process pump draws the wash liquor from the laundry machine through a particulate filter positioned in a liquid conduit to a venturi that is in fluid communication with the ozone generator. The venturi creates a vacuum adjacent the ozone generator so that the ozone is entrained into the wash liquor as it is returned to the laundry machine for further use in the wash process. The amount of ozone generated by the ozone generator that is dispersed into the wash liquor by the ozone injector and entrained into the wash liquor by the ozone entrainer varies with the wash load. Thus, the wash chemistry of the predetermined wash formula is balanced with the ozone introduced into the wash liquor during the wash process.

A preferred method according to the invention includes the steps of: (a) selecting a predetermined wash formula that corresponds to the size and content of the wash load; (b) providing a load signal from the laundry machine to the controller based on the predetermined wash formula; (c) varying the amount of ozone generated by an ozone generator in response to a control signal received from the controller that corresponds to the load signal; (d) providing the ozone generated by the ozone generator to an ozone injector adjacent the drain of the laundry machine; and (e) dispersing the ozone directly into the wash liquor in the laundry machine during the wash process.

In an alternative embodiment, the method includes the further steps of: (f) using a process pump activated by the controller, drawing the wash liquor from the laundry machine through a particulate filter positioned in a liquid conduit to a venturi that is in fluid communication with the ozone generator; (g) using the venturi, creating a vacuum adjacent the ozone generator so that the ozone is entrained into the wash liquor in a aside arm recirculation assembly; and (h) returning the ozonated wash liquor to the laundry machine during the wash process.

Accordingly, the concentration of the ozone dispersed into the wash liquor by the ozone injector (or dispersed into the wash liquor by the ozone injector and entrained into the wash liquor by the ozone entrainer) is varied by the controller in response to the predetermined wash formula for the size and content of the wash load. Further, the wash chemistry is balanced with the ozone dispersed into the wash liquor by the ozone injector (or dispersed into the wash liquor by the ozone injector and entrained into the wash liquor by the ozone entrainer) so that optimal cleansing, environmental benefits and cost-effectiveness are achieved by the wash process. By varying the ozone concentration in the wash liquor to balance the wash chemistry with the ozone concentration, the present invention reduces the amount of wash chemistry (e.g., detergents, bleaches, surfactants, disinfectants and additives) energy and water required to be used in the wash process.

To further reduce the amount of energy and water consumed during the wash process, the ozonated laundry system of the present invention includes the capability to re-use at least a portion of the water from the municipal water supply utilized by the laundry machine during the wash process. In particular, the open-loop, ozonated laundry system disclosed herein is converted to a closed-loop, ozonated laundry system. The closed-loop, ozonated laundry system includes a conventional sump and a T-valve adjacent the drain of the laundry machine for selectively diverting the wastewater from the laundry machine to a sewer or to the sump. The closed-loop, ozonated laundry system further includes a bag filter and a sump pump for pumping the wastewater from the sump through the bag filter and back into the laundry machine to be re-used. In an alternative embodiment, the closed-loop, ozonated laundry system farther includes a holding tank for temporarily retaining a sufficient amount of filtered water to fill the laundry machine and a distribution pump for distributing the filtered water in the holding tank to the laundry machine. The closed-loop, ozonated laundry system may also include a level detector and a one-way valve for filling the sump with water from the municipal water source if the level of the wastewater in the sump is low.

A preferred method of operation of the closed-loop, ozonated laundry system according to the invention includes the steps of: (a) filling the laundry machine with water from the municipal water source or, if available, from the sump; (b) if necessary, filling the sump with water from the municipal water source; (c) performing the break cycle of the wash process; (d) during the first drain cycle of the wash process, diverting the wastewater from the laundry machine to a sewer; (e) re-filling the laundry machine with filtered water from the sump; (f) performing a subsequent cycle of the wash process; (g) during the subsequent drain cycle of the wash process, diverting the wastewater from the laundry machine to the sump; and (h) repeating steps (e) through (g) as necessary to complete the wash process.

BRIEF DESCRIPTION OF THE DRAWINGS

The foregoing objects of the invention, as well as others, will become more readily apparent by referring to the following detailed description and the appended drawings in which:

FIG. 5 is a table illustrating a predetermined wash formula for treating laundry with ozone in accordance with the present invention;

FIG. 6 is a schematic diagram illustrating a preferred embodiment of an injector assembly including an adapter for removably securing an ozone injector adjacent the drain of a laundry machine in accordance with the present invention;

FIG. 7 is an exploded view of the injector assembly of FIG. 6;

FIG. 8 is a detail view of the adapter of the injector assembly of FIG. 6;

DETAILED DESCRIPTION OF THE PREFERRED EMBODIMENTS

While the invention is described herein in the context of a single laundry machine for convenience of explanation, the present invention is not intended to be so limited. In particular, the ozonated laundry system and method described herein is equally applicable in the context of multiple laundry machines, such as a plurality of interconnected laundry machines in a commercial or institutional application. For example, it is well within the ordinary skill of one in the art to apply the ozonated laundry system and method described herein to a plurality of laundry machines in fluid communication with a common supply of water and in electrical communication with a common controller. Such a laundry system and method is typically associated with, for example, an educational institution, a medical facility, a prison, a temporary lodging facility, such as a hotel or motel, or a commercial manufacturing plant in which the workers are required to wear protective clothing supplied by the employer which must be cleaned on a regular basis.

Figure 1A:
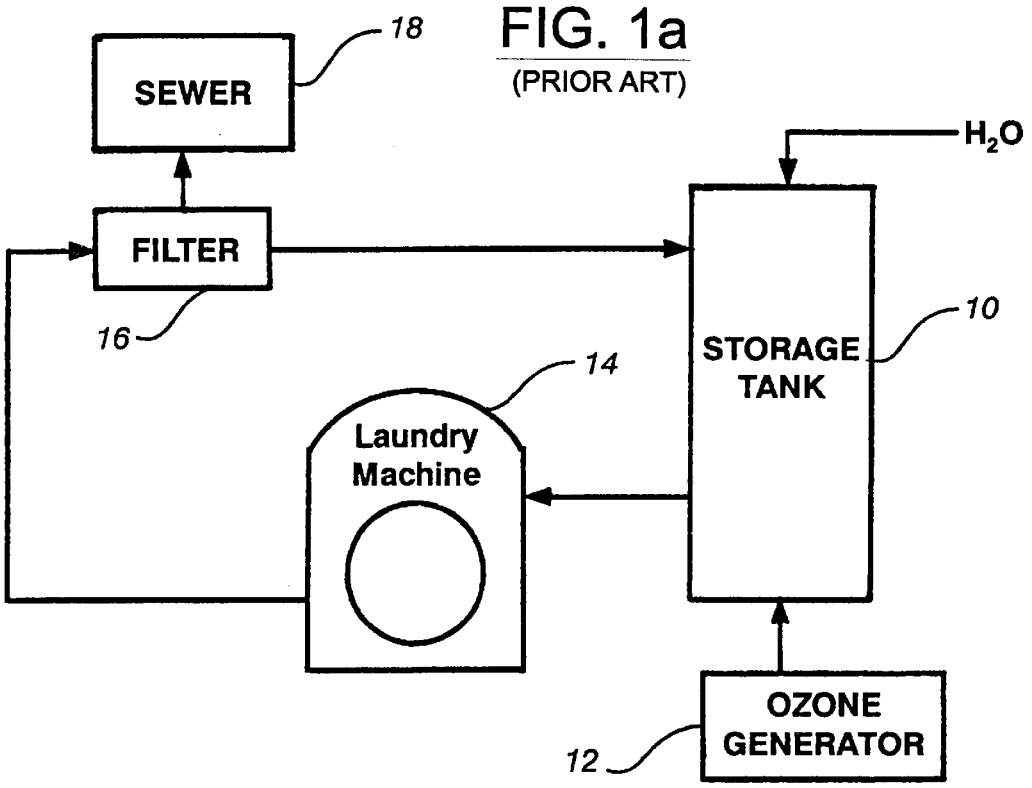
FIG. 1a (PRIOR ART)
FIG. 1*a* is a schematic diagram of a prior art closed-loop, ozonated laundry system.
Figure 1B:
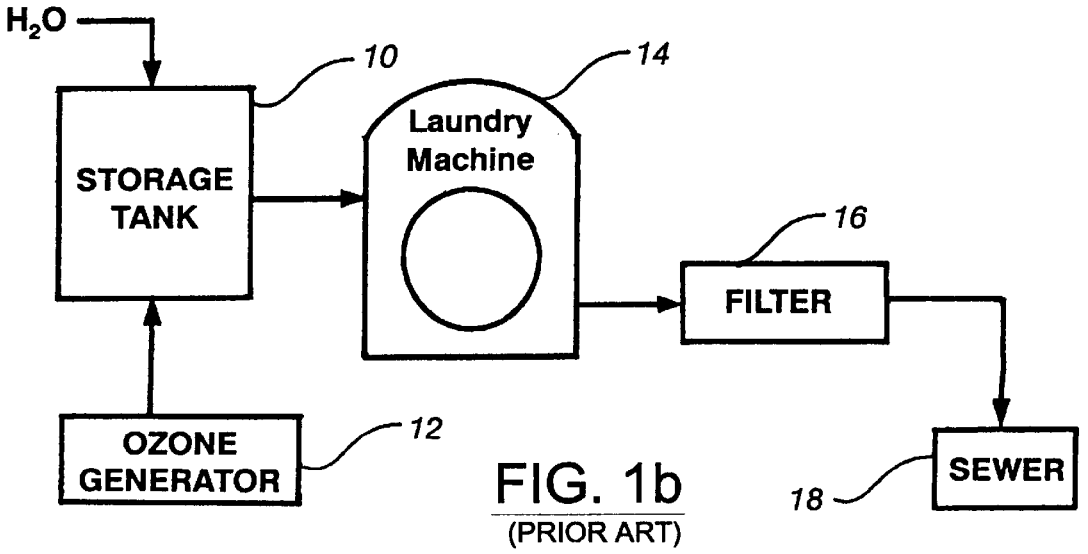
FIG. 1b (PRIOR ART)
FIG. 1*b* is a schematic diagram of a prior art open-loop, ozonated laundry system.
Figure 2A:
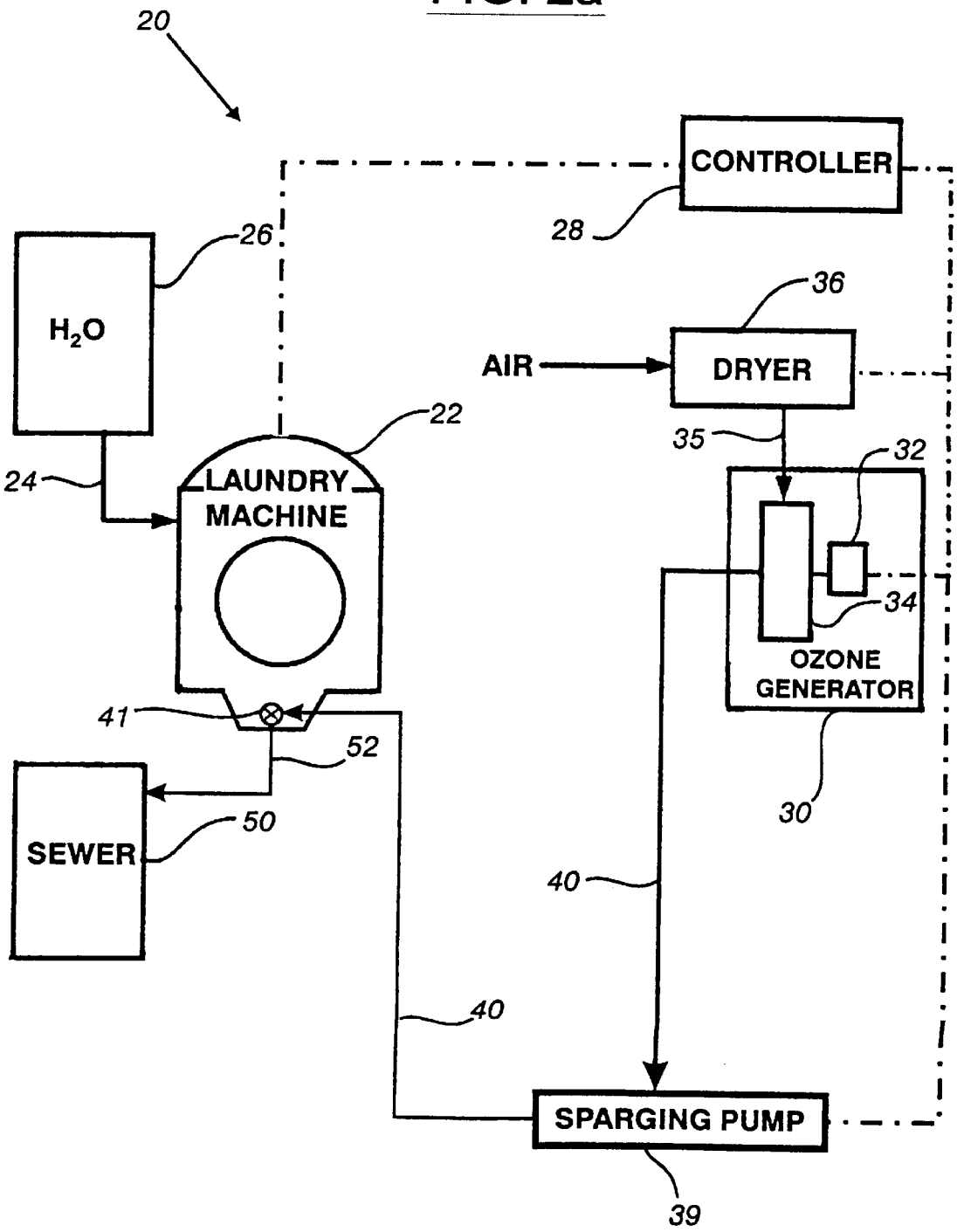
FIG. 2*a* is a schematic diagram of a preferred embodiment of an improved open-loop, ozonated laundry system in accordance with the present invention.

FIG. 2*a* is a simplified schematic diagram of an improved open-loop, ozonated laundry system 20 in accordance with the present invention. The open-loop laundry system 20 includes a laundry machine 22 which is preferably of the type utilized in a commercial or institutional laundry installation, such as a laundromat, hotel, school dormitory, temporary lodging facility or other establishment in which a large quantity of laundry is washed. However, the laundry machine 22 may also be a conventional washing machine of the type found in a private residence equipped with an automated detergent dispenser or otherwise adapted to accept a wash formula from a controller. The laundry machine 22 performs a laundry wash process consisting of various cycles. The various cycles typically include one or more fill, break (i.e., agitation), wash, rinse, extraction and drain cycles. The wash process begins when the wash load is selected and ends when a final drain of the wash liquor is complete. The laundry machine 22 has a conventional means for selecting a wash load from a plurality of predetermined wash load selections. The wash load selections are based on the wash load (i.e., the size and type of articles to be washed). For example, the wash load may be selected from the group consisting of light, medium and heavy. However, other, more specific wash load selections can be included in the selection group. The wash load selection determines the wash formula for the laundry, and thus, the water temperatures and water levels, the wash chemistry, the different cycles of the wash process and, ultimately, the ozone concentration in the wash liquor.

At the beginning of a wash or rinse cycle in the wash process, hot and/or cold water, depending on the wash load selection, enters the laundry machine 22 through a water supply conduit 24 from a municipal water source 26. When the wash load is selected, a wash formula corresponding to the wash load selection is provided to a controller 28. Preferably, each wash load selection has a unique wash formula corresponding to the wash load. The wash formula is stored in a machine readable format such as a coded card or film that electronically determines the specific control signals to be transmitted by the controller 28 to the laundry machine 22, and to other components of the laundry system 20 as will be described. The wash formula indicates in real time an input of hot/cold water, a predetermined wash chemistry (e.g., combination of detergents, bleaches, additives and/or surfactants), and the number and the duration of each type of wash cycle for the particular wash load selection. Thus, each wash formula determines the wash chemistry, the water level and temperature, and the cycles required for the particular wash load.

A conventional wash chemistry dispenser (not shown) attached to the laundry machine 22 dispenses the wash chemistry into the wash liquor in response to a wash chemistry control signal generated by a microprocessor (not shown). The microprocessor is in electrical communication with the laundry machine 22 and the controller 28, a plurality of wash chemistry containers and a dispensing pump connected to the plurality of containers. When the wash formula indicates that the wash chemistry is to be dispensed into the wash liquor, the microprocessor receives the wash chemistry control signal from the controller 28. Based on the wash formula requirements, the microprocessor determines the specific wash chemistry and the volume of the wash chemistry to be dispensed. The microprocessor then generates the wash chemistry control signal which activates the dispensing pump to introduce the wash chemistry into the wash liquor in the laundry machine 22.

The controller 28 is in electrical communication with the laundry machine 22 and transmits the wash formula control signal to the laundry machine. As will be described, the controller 28 also transmits control signals corresponding to the wash load selection to an ozone generator 30, an air dryer 36 and a sparging pump 39, as necessary. Preferably, the controller 28 obtains the wash formula control signal from a programmable data input means associated with a storage medium (e.g., random access memory, semiconductor or magnetic read-write memory device, such as a magnetic tape, floppy disk or hard disk) in electrical communication with the controller 28. The storage medium then automatically transmits the necessary control signals to the ozone generator 30, the air dryer 36 and the sparging pump 39.

The ozone generator 30 comprises a power supply 32 electrically connected to an ozonator 34. The power supply 32 is adapted to receive a power supply control signal from the controller 28 and is preferably variable (e.g., a high voltage, high frequency, variable energy source coupled with load capacitance). Power is varied, for example by a rheostat, to vary the load capacitance coupled to the power supply 32. Upon receiving the power supply control signal from the controller 28, the power supply 32 varies an output potential in response to the control signal. The output potential is preferably varied from about 0 to about 220 volts AC. Preferably, the output potential is varied by changing the coupling capacitance. Varying the output potential instead of the amplitude (which increases resistance) minimizes the production of heat in the power supply 32, and thereby prolongs the service life of the electronics associated with the power supply 32. Regardless, the output potential is transmitted to the ozonator 34. The ozonator 34 produces different concentrations of ozone in response to the variable output potential received from the power supply 32. The power supply 32 can also be located remote from the ozone generator 30, for example proximate to the controller 28.

Prior to or during ozone production, the controller 28 transmits a dryer control signal to activate the air dryer 36. Ambient air enters the dryer 36 where it is desiccated such that the dried air has a dew point temperature of from about −80° F. to about −100° F. The dryer 36 is in fluid communication with the ozonator 34 through an air conduit 35. The ozonator 34 generates ozone by passing the desiccated air received from the dryer 36 through a discharge field. Part of the air in the ozonator 34 is transformed into charged oxygen ions that recombine to form $O_3$, or ozone. The ozone generated by ozone generator 30 is provided on demand to a sparging pump 39 through an ozone feed conduit 40 in response to a sparging pump control signal from the controller 28. The sparging pump 39 pumps the ozone generated by the ozone generator 30 through the ozone feed conduit 40 to an injector assembly 41 which disperses the ozone directly into the wash liquor in the laundry machine 22 during the wash process, as will be described hereafter in greater detail.

Figure 2B:
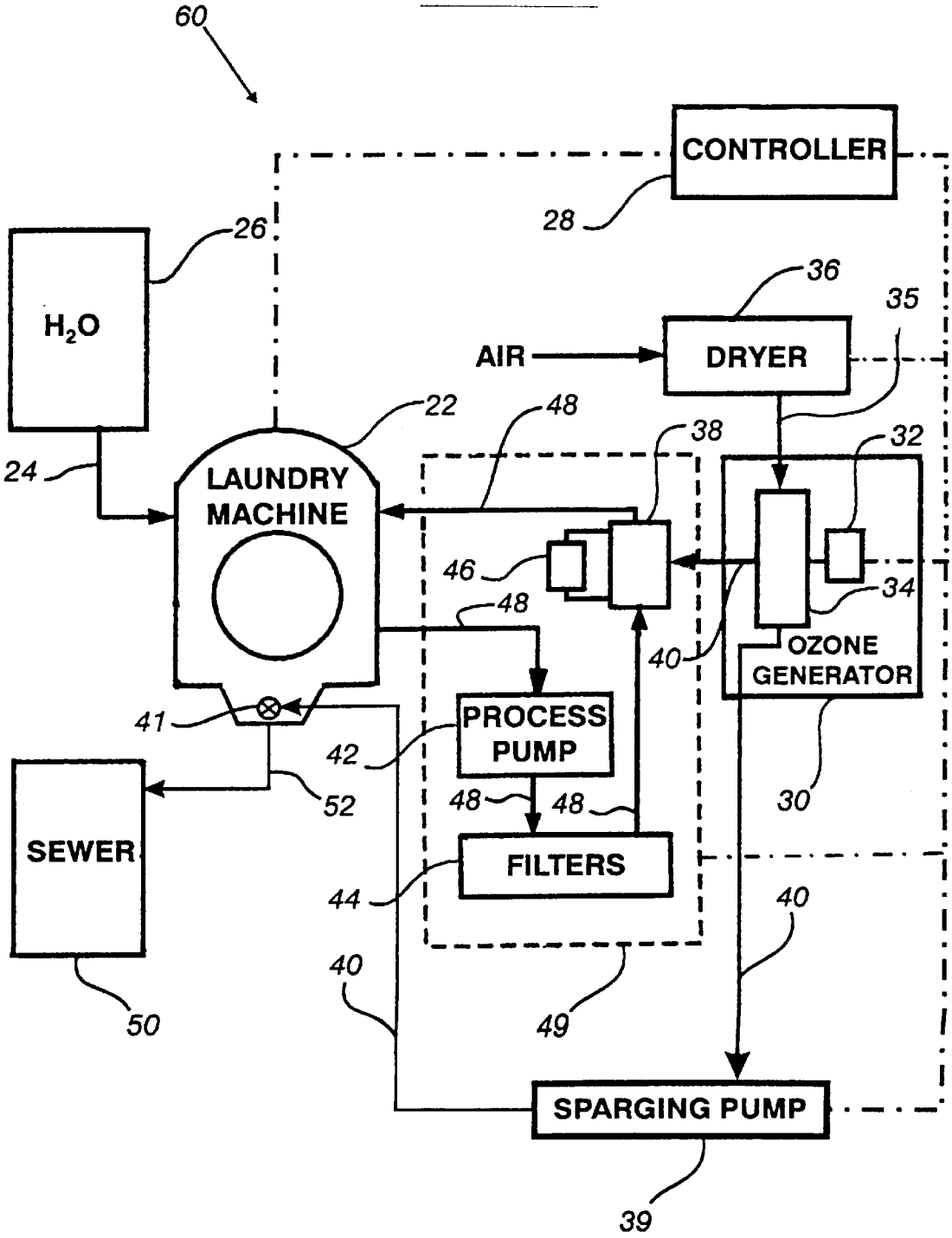
FIG. 2*b* is a schematic diagram of an alternative embodiment of an improved open-loop, ozonated laundry system in accordance with the present invention including a side arm recirculation assembly.

FIG. 2*b* is a simplified schematic diagram of an improved open-loop, ozonated laundry system 60 in accordance with the present invention. The laundry system 60 is identical to the laundry system 20 previously described with the addition of a side arm recirculation assembly 49 of the type described in U.S. Pat. No. 5,806,120 to McEachern and assigned to the assignee of the present invention, the disclosure of which is expressly incorporated herein by reference. The side arm recirculation assembly 49 comprises a process pump 42, one or more filters 44 and an ozone entrainer 38 for entraining ozone generated by the ozone generator 30 into the wash liquor as the wash liquor is recirculated to the laundry machine 22.

During the wash process, the wash liquor is drawn out of the laundry machine 22 by the process pump 42 through a wash liquor conduit 48 and passed through at least one filter 44 when the wash formula indicates to the controller 28 to activate the process pump. The process pump 42 is in fluid communication with the laundry machine 22 and the filter 44 to draw the wash liquor out of the laundry machine past the filter and back into the laundry machine. Additional filters 44 may also be used to remove smaller particulates from the wash liquor. The wash liquor is drawn past the filter(s) 44 to the ozone entrainer 38, which preferably comprises a venturi. There, the ozone produced by the ozone generator 30 is entrained into the wash liquor. A flow valve 46 bypasses the ozone entrainer 38 to regulate the flow rate of the wash liquor past the venturi, thereby varying the concentration of ozone entrained into the wash liquor. The flow valve 46 can be adjusted manually, but preferably is adjusted automatically, to increase or decrease the flow rate of the wash liquor past the venturi. As will be readily understood by those skilled in the art, adjusting the flow rate through the flow valve 46 varies the amount of ozone that is entrained into the wash liquor. Although the flow rate of the wash liquor may be varied, it is preferably maintained at about 10 standard cubic feet per hour (SCFH). The wash liquor is returned to the laundry machine 22 through the wash liquor conduit 48, thereby completing the side arm recirculation assembly 49 portion of the laundry system 60. Accordingly, the ozone generated by the ozone generator 30 is entrained into the wash liquor to produce a predetermined ozone concentration in the wash liquor corresponding to the wash load selection.

Preferably, the predetermined wash chemistry of the wash load selection is balanced with the amount of ozone dispersed into the wash liquor by the injector assembly 41, or dispersed and/or entrained into the wash liquor by the ozone entrainer 38 of the side arm recirculation assembly 49. As previously described, a predetermined wash chemistry (e.g., a combination of detergents, bleaches, additives and surfactants) is dispensed to the laundry machine 22 in response to the wash load selection and the corresponding wash formula. Each wash load selection further corresponds to a predetermined amount of ozone to be dispersed, or dispersed and/or entrained, into the wash liquor. Thus, the wash chemistry is balanced with the concentration of ozone in the wash liquor. In operation, the ozone-enhanced chemistry of the detergents, bleaches, additives and surfactants, cleans and disinfects the laundry, minimizes or eliminates ozone off-gassing, conserves water consumption and requires less energy to heat the wash water.

By properly varying the ozone concentration in the wash liquor in accordance with the wash load, the ozone is utilized effectively and off-gassing of ozone into the atmosphere is minimized or eliminated. A reduction in the wash chemistry of as much as 50% is possible when varying the ozone concentration in the wash liquor in accordance with the wash load. In addition, the wash and rinse cycles of the wash process can be reduced in time, or eliminated altogether, thereby conserving water and further reducing costs associated with the wash process. Ozone also reduces energy consumption and hot water usage because 100° F. water in an ozone-enhanced wash liquor accomplishes the same or better level of cleaning and disinfection as 140–160° F. water.

In the preferred and alternative embodiments of the invention illustrated in FIG. 2*a* and FIG. 2*b*, wash liquor from the laundry machine 22 is drained after each wash, rinse and extraction cycle to a municipal sewer 50 through a drain conduit 52, thereby completing the open-loop laundry system. In the alternative embodiment of the invention illustrated in FIG. 2*b*, the wash liquor from the laundry machine 22 is recycled as necessary through the side arm recirculation assembly 49 during each cycle of the wash process until the laundry treatment process reaches the final rinse cycle, whereupon the wash liquor is drained to the municipal sewer 50 through the drain conduit 52. However, the laundry system and method described herein is equally applicable to a closed-loop, ozonated laundry system in which the wash liquor is diverted through a return fluid conduit past one or more filters (where particulate waste is removed) to a storage tank (where the wash liquor is treated, for example with ozone) and reused in the wash process, as will be described hereafter.

Figure 3A:
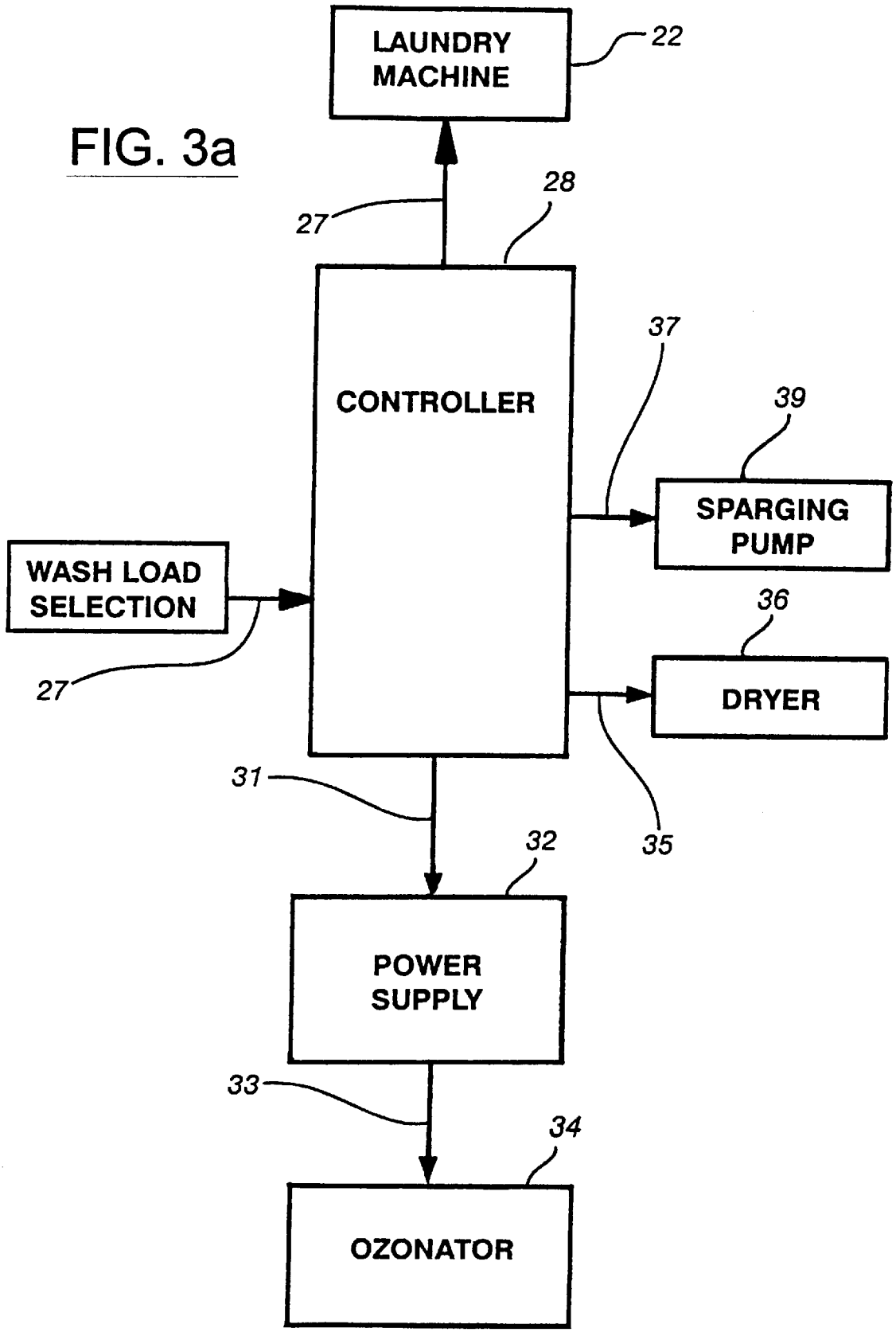
FIG. 3*a* is an electrical connection diagram illustrating the electrical signal paths required by the improved open-loop, ozonated laundry system of FIG. 2*a;*

FIG. 3*a* is a schematic diagram illustrating the electrical connections for operation of the improved open-loop, ozonated laundry system 20 of FIG. 2*a*. A load signal 27 corresponding to the wash load selection is provided to the controller 28 and thereafter to the laundry machine 22. In response to the load signal 27, the controller 28 transmits a power supply control signal 31 to the variable power supply 32. Upon receiving the power supply control signal 31 from the controller 28, the power supply 32 varies the output potential 33 to the ozonator 34. The output potential 33 transmitted by the power supply 32 varies the amount of ozone produced by the ozonator 34. At the same time that the power supply control signal 31 is sent to the power supply 32, the dryer 36 is simultaneously activated by a dryer control signal 35 from the controller 28 to desiccate the air to be ozonated. The controller 28 further transmits a sparging pump control signal 37 to the sparging pump 39 to pump the ozone generated by the ozonator 34 to the laundry machine 22 in response to the load signal 27.

Figure 3B:
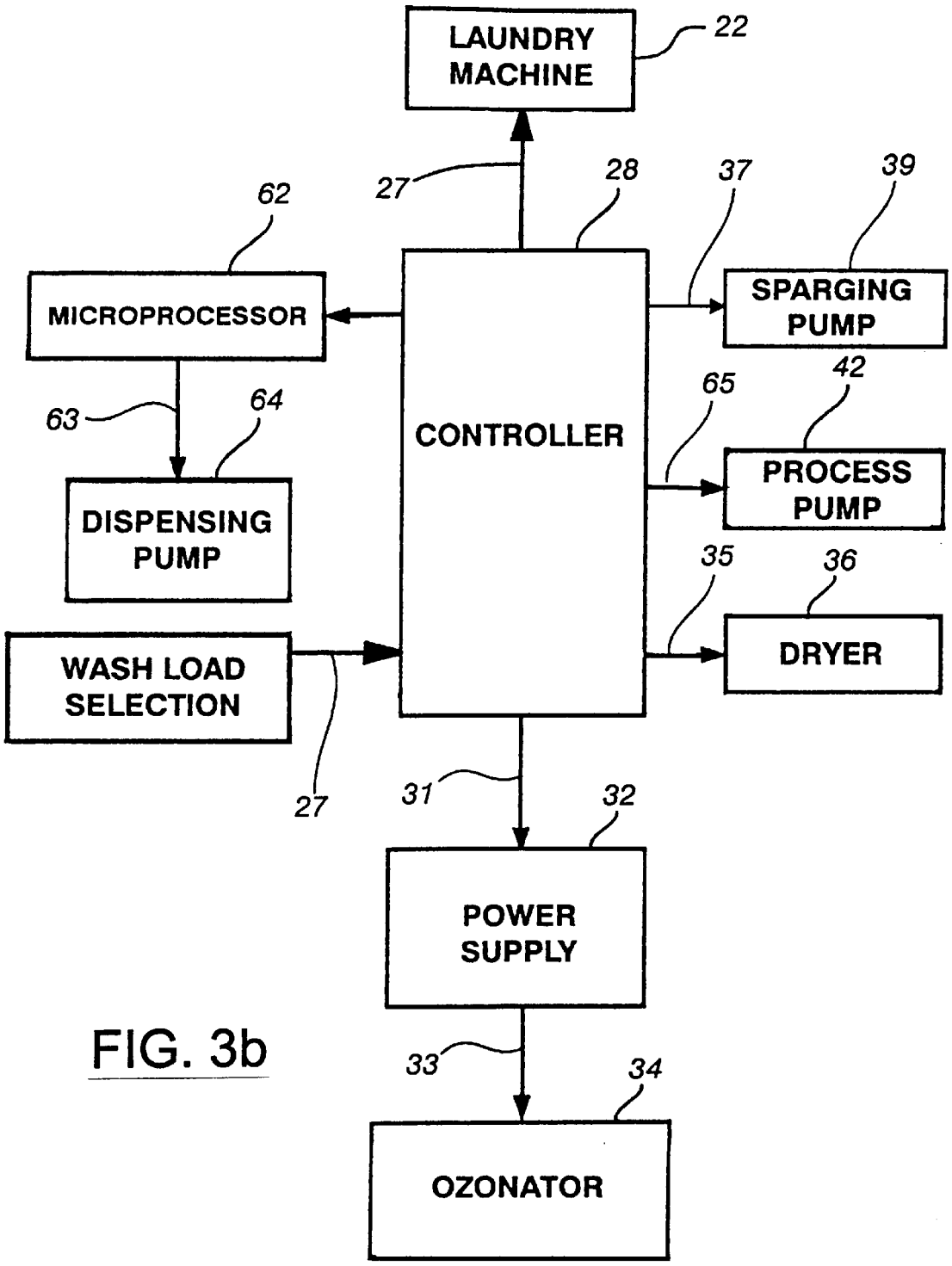
FIG. 3*b* is an electrical connection diagram illustrating the electrical signal paths required by the improved open-loop, ozonated laundry system of FIG. 2*b;*

FIG. 3*b* is a schematic diagram illustrating the electrical connections for operation of the improved open-loop, ozonated laundry system of FIG. 2*b*. The wash chemistry dispenser (not shown) comprises a microprocessor 62 in electrical communication with the controller 28, a plurality of wash chemistry containers (not shown) and a dispensing pump 64 connected to the plurality of containers. The microprocessor 62 receives a dispensing control signal 63 from the controller 28. The dispensing control signal 63 is then used by the microprocessor 62 to activate the dispensing pump 64 to dispense the appropriate wash chemistry into the wash liquor. As previously described, the load signal 27 corresponding to the wash load selection is transmitted to the controller 28 and thereafter to the laundry machine 22. As before, the controller 28 transmits the power supply control signal 31 to the variable power supply 32. Upon receiving the power supply control signal 31 from the controller 28, the power supply 32 varies the output potential to the ozonator 34 as previously described to vary the amount of ozone produced by the ozonator 34. Simultaneously, the controller 28 transmits the dryer control signal 35 which activates the dryer 36 as previously described to desiccate the air to be ozonated, and transmits the sparging pump control signal 37 which causes the sparging pump 39 to pump a portion of the ozone generated by the ozonator 34 to the laundry machine 22. The process pump 42 draws the wash liquor from the laundry machine 22 when the controller 28 transmits a process pump control signal 65 to the process pump in response to the load signal 27. As previously described, the process pump 42 draws the wash liquor past the filter(s) 44 and the ozone entrainer 38. Accordingly, a portion of the ozone generated by the ozonator 34 is entrained into the wash liquor as it is returned to the laundry machine 22. Sensors (not shown) can be placed along the side-arm recirculation assembly 49 to determine the concentration of the ozone and/or the wash chemistry in the wash liquor. Data from the sensors can then be transmitted to the controller 28 to iteratively update the amount of detergents, bleaches, additives and/or surfactants to be dispensed by the dispensing pump 64, or the amount of ozone to be generated by the ozonator 34 in response to empirical data.

Figure 4:
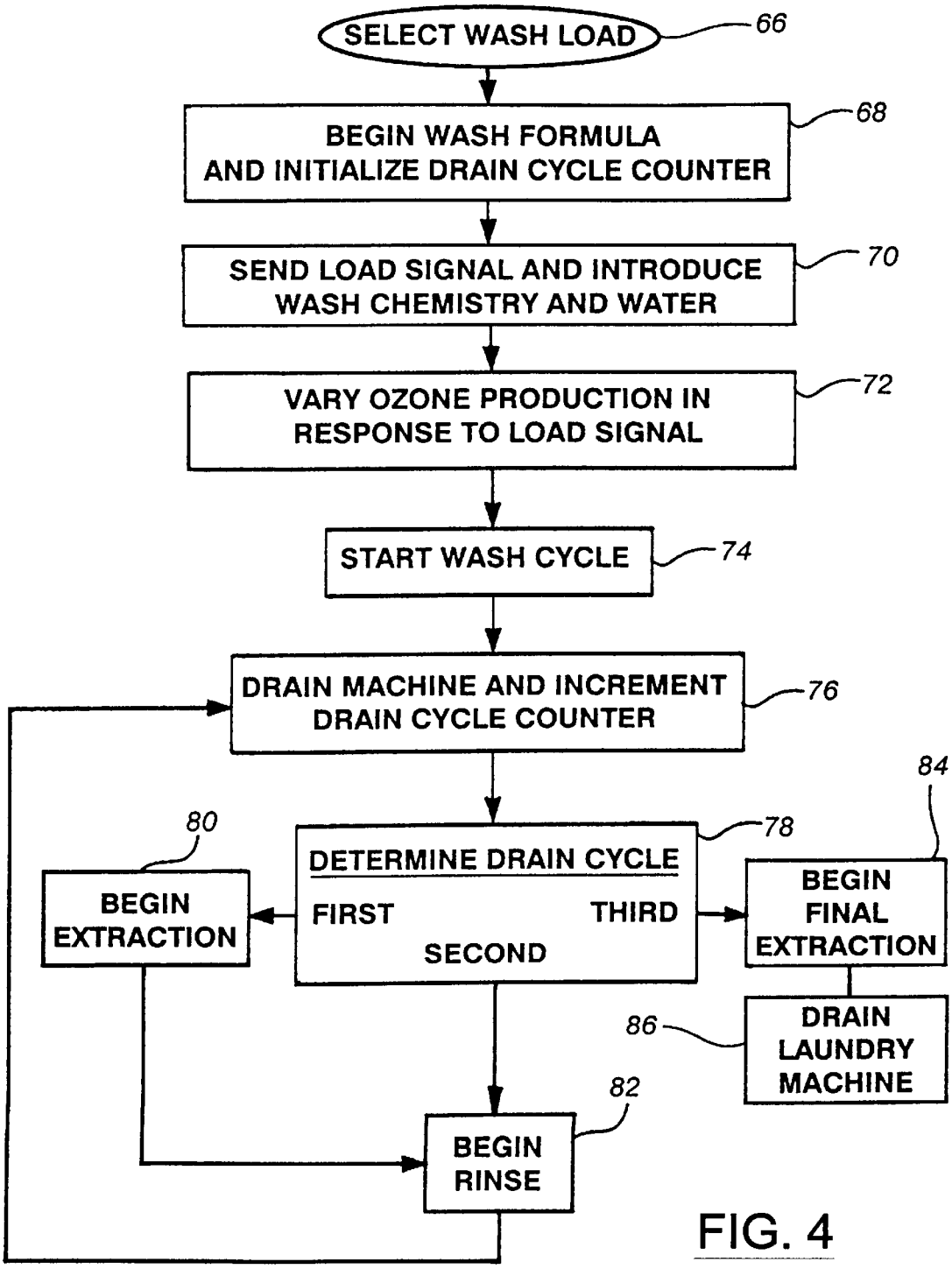
FIG. 4 is a flowchart of a preferred method for treating laundry with ozone in accordance with the present invention.

FIG. 4 is a flowchart of a preferred method for treating laundry with ozone in accordance the present invention. The first step 66 of the method is to select the wash load. A user selects the wash load from a plurality of wash load selections corresponding to the type of laundry load, and in particular, to the size of the wash load, the temperature of the water to be used and the articles to be washed. Selection of the wash load begins a wash formula, which corresponds to the wash load selected at step 66, and initializes a drain cycle counter at step 68. The wash load selection determines the load signal 27 that is sent to the controller 28 at step 70. The predetermined wash chemistry, and the temperature and amount of the water to fill the laundry machine 22, which are both determined by the wash formula, are also introduced to the laundry machine at step 70. The power supply control signal 31, which is also based on the wash formula, is sent from the controller 28 to the power supply 31 at step 72. The output potential 33 from the power supply 32 to the ozonator 34 is varied at step 72 to produce the desired amount of ozone in response to the output potential. As necessary, the air dryer 36 is also activated by the controller in response to the wash formula at step 72.

The wash cycle for the wash load selection is initiated at step 74. In the improved open-loop, ozonated laundry system of FIG. 2*a* described above, the sparging pump 39 pumps the ozone generated by the ozonator 34 to the injector assembly 41 to be dispersed into the wash liquor adjacent the drain of the laundry machine 22. In the improved open-loop, ozonated laundry system of FIG. 2*b* described above, the wash liquor is also drawn out of the laundry machine 22 by the process pump 42 past the filter(s) 44 to the ozone entrainer 38, where ozone is entrained into the wash liquor. At the end of the wash cycle, the laundry machine 22 is drained and the drain cycle counter is incremented at step 76. Also at step 76, the power supply control signal 31 sent to the power supply 32 by the controller 28 interrupts the generation of ozone by the ozonator 34.

The current drain cycle, based on the drain cycle counter, is determined at step 78 by the controller 28. If the drain cycle counter indicates a first cycle, the laundry machine 22 proceeds to an extraction cycle at step 80 where the wash liquor is extracted from the laundry and diverted to the municipal sewer 50, or is recycled through the side arm recirculation assembly 49 for re-use during the next cycle of the wash process. After the wash liquor is extracted at step 80, the laundry machine proceeds to a rinse cycle at step 82. If instead the drain cycle counter indicates a second cycle, the laundry machine 22 proceeds directly to the rinse cycle at step 82. Once again, ozone may be dispersed into the wash liquor, or dispersed and/or entrained into the wash liquor, during the rinse cycle 82 depending on the wash formula corresponding to the wash load signal 27.

As will be appreciated by those skilled in the art, the amount of ozone dispersed into the wash liquor, or dispersed and/or entrained into the wash liquor, during the rinse cycle can vary from the amount of ozone introduced into the wash liquor during the wash cycle. The load signal 27 indicates to the controller 28 whether ozone is to be produced for the particular wash load selection during the rinse cycle. When the wash formula indicates to the controller 28 to produce ozone, the controller activates the sparging pump 39, the process pump 42, the air dryer 36 and the power supply 32 in the manner described in steps 72 and 74. Additional wash chemistry may be introduced to the laundry machine 22 as required by the wash formula at step 82. Accordingly, the controller 28 can vary the concentration of ozone in the wash liquor during the rinse cycle, as well as during the wash cycle, in response to the load signal 27.

After the rinse cycle in step 82, the laundry machine 22 is drained and the drain cycle counter is incremented again at step 76. If the drain cycle counter indicates a third cycle, the wash formula begins a final extraction cycle at step 84 where the wash liquor is again extracted from the laundry. The laundry machine 22 is then drained for the final time at step 86. The method of the present invention insures that the ozone-enhanced wash chemistry of the wash liquor cleanses and disinfects the laundry in the most cost-effective manner. Additionally, by utilizing the ozone-enhanced wash chemistry, water is conserved, the amount of energy required to heat the water is reduced, and the amount of detergents, bleaches, additives and surfactants required by the wash chemistry to clean and disinfect the laundry is reduced.

FIG. 5 is a table illustrating a preferred embodiment of a wash formula for treating laundry with ozone in accordance with the present invention. The wash formula indicates a particular predetermined step in the wash process by a step number 90. Each step 90 corresponds to one or more cycles 92 of the wash process. The cycles 92 include, but are not limited to: a break or agitation cycle; a bleach cycle; a drain of the wash liquor from the laundry machine 22 cycle; an intermediate extraction of the wash liquor by spinning the laundry machine 22 cycle; a rinse cycle; a sour addition cycle; a final extraction of the wash liquor by spinning the laundry machine 22 cycle; and a final drain cycle. Other cycles may be included and certain cycles may be deleted depending on the particular wash load. Each cycle 92 may introduce hot and/or cold water 94 to the laundry machine 22. The temperature of the water 94 is based on the particular wash load. When each cycle 92 introduces water 94 to the laundry machine 22, a predetermined level 96 of water is introduced: Level 1 is a low water level; Level 2 is a medium water level; and Level 3 is a high water level. Further, each cycle 92 is performed for a period of time 98, preferably measured in minutes. Finally, each cycle 92 may dispense a specific wash chemistry or a plurality of different wash chemistries 100 in response to the load signal 27 during a single wash process. Each wash chemistry preferably includes a preselected combination of detergents (1), alkalies (2), bleaches (3) and sours (4), however, other wash additives may also be included.

A preferred embodiment of the injector assembly 41 is illustrated in FIGS. 6–8. As shown in FIG. 6, the injector assembly 41 is secured to the laundry machine 22 adjacent the drain from which the laundry wastewater is diverted to the municipal sewer 50. Accordingly, the ozone generated by ozone generator 30 and pumped to the laundry machine 22 by sparging pump 39 through ozone feed conduit 40 is dispersed directly into the wash liquor at the base of the laundry machine. The natural action of the ozone, which is significantly less dense than the wash liquor, causes the ozone to be dispersed uniformly upwardly through the wash liquor. A check valve 43 may also be positioned between the sparging pump 39 and the injector assembly 41 so that the wash liquor does not back-flow directly into the sparging pump 39 or the ozone generator 30.

As best shown in FIG. 7, injector assembly 41 comprises an ozone injector 54, an adapter 56 for removably securing the ozone injector adjacent the drain of the laundry machine 22 and a gasket 58 for insuring that the wash liquor does not leak from the laundry machine 22 at the location where the injector assembly attaches to the laundry machine. The ozone injector 54 may be any means for dispersing ozone into the wash liquor, such as an ozone diffuser stone. Preferably, however, the ozone injector 54 is a porous sparging rod 53 fitted at one end with an externally threaded adapter mount 55 for engaging the adapter 56, as will be described. Preferably, the sparging rod 53 is a 2 micron perforated stainless steel rod having an inner diameter of about ¼ inch and an outer diameter of about ⅜ inch. Preferably, the sparging rod 53 is about 12 inches or longer in length. The hollow adapter mount 55 is provided with a ¼ inch NPT internal thread for engaging the externally threaded sparging rod 53. Alternatively, the sparging rod may be inserted within and welded to the hollow adapter mount 55. The adapter mount 55 is also provided with a 1 inch hex head for threading the ozone injector 54 through the adapter 56.

As best shown in FIG. 8, the adapter 56 comprises a hollow body positioned within an annular mounting collar 57. The body of the adapter 56 is internally threaded to receive the externally threaded adapter mount 55 of the ozone injector 54. The annular collar 57 of the adapter 56 has a plurality of small diameter, circumferentially spaced holes 59 for securely attaching the injector assembly 41 to the wall of the laundry machine 22 adjacent the drain. Preferably, the holes 59 in the mounting collar 57 of the adapter 56 are used as a template to drill matching holes through the wall of the laundry machine 22. A large diameter clearance hole is also drilled through the wall of the laundry machine 22 to accept the body of the adapter 56. When assembled, gasket 58, which is preferably made of a compressible material, for example natural rubber or synthetic rubber, such as Viton®, is positioned between the exterior surface of the wall of the laundry machine 22 and the mounting collar 57 of the adapter 56. The adapter 56 is then secured to the wall of the laundry machine 22 with a corresponding plurality of tight fitting pop rivets or other fasteners 51. Thereafter, the ozone injector 54 is inserted into the laundry machine 22 through the body of the adapter 56 and threaded tightly therein using the hex head of the adapter mount 55. Accordingly, the injector assembly 41 is securely attached to the laundry machine 22, yet the ozone injector 54 is removably secured to the adapter 56 so that the sparging rod 53 may be readily cleaned, repaired or replaced.

Figure 9A:
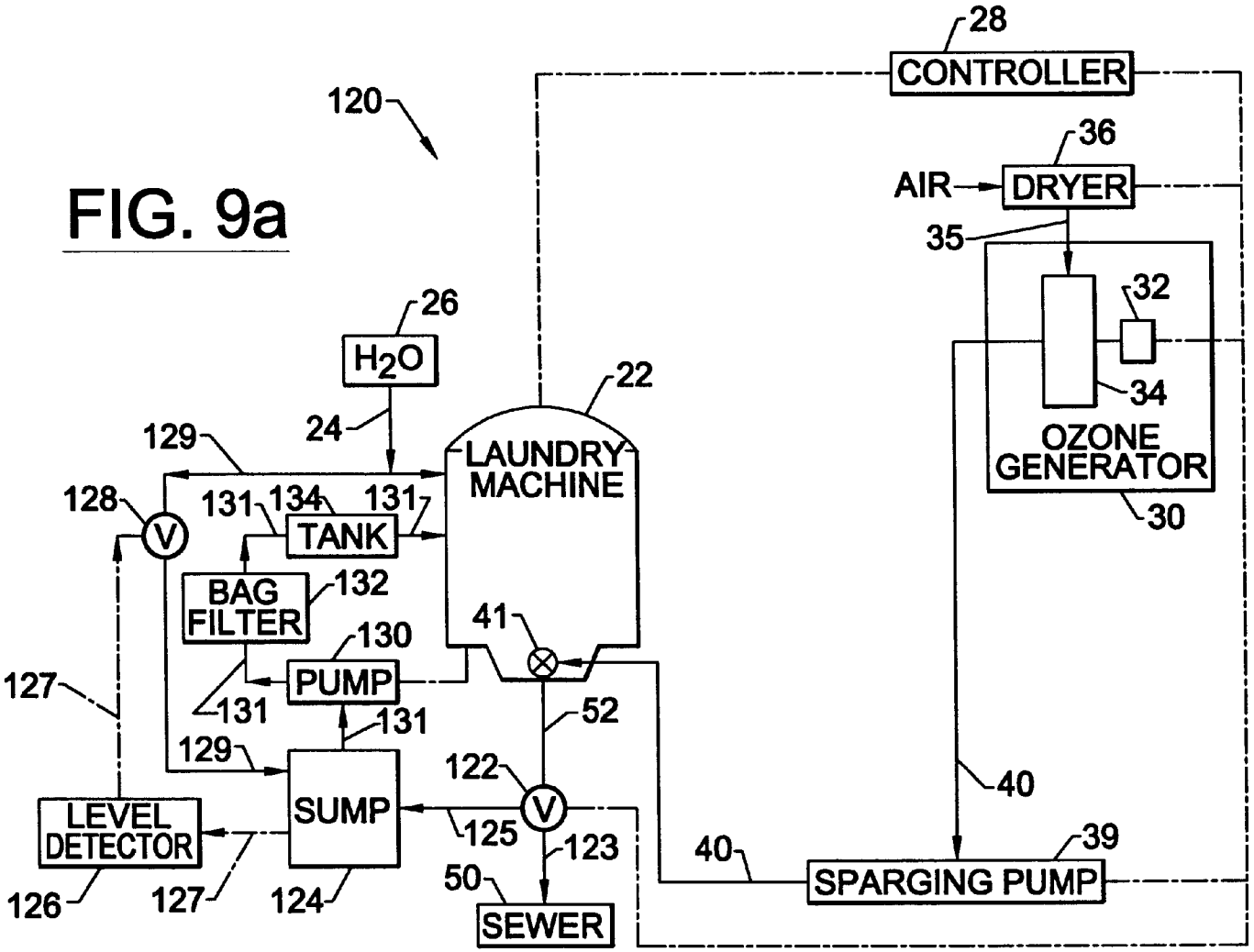
FIG. 9*a* is a schematic diagram of a preferred embodiment of an improved closed-loop, ozonated laundry system in accordance with the present invention.
Figure 9B:
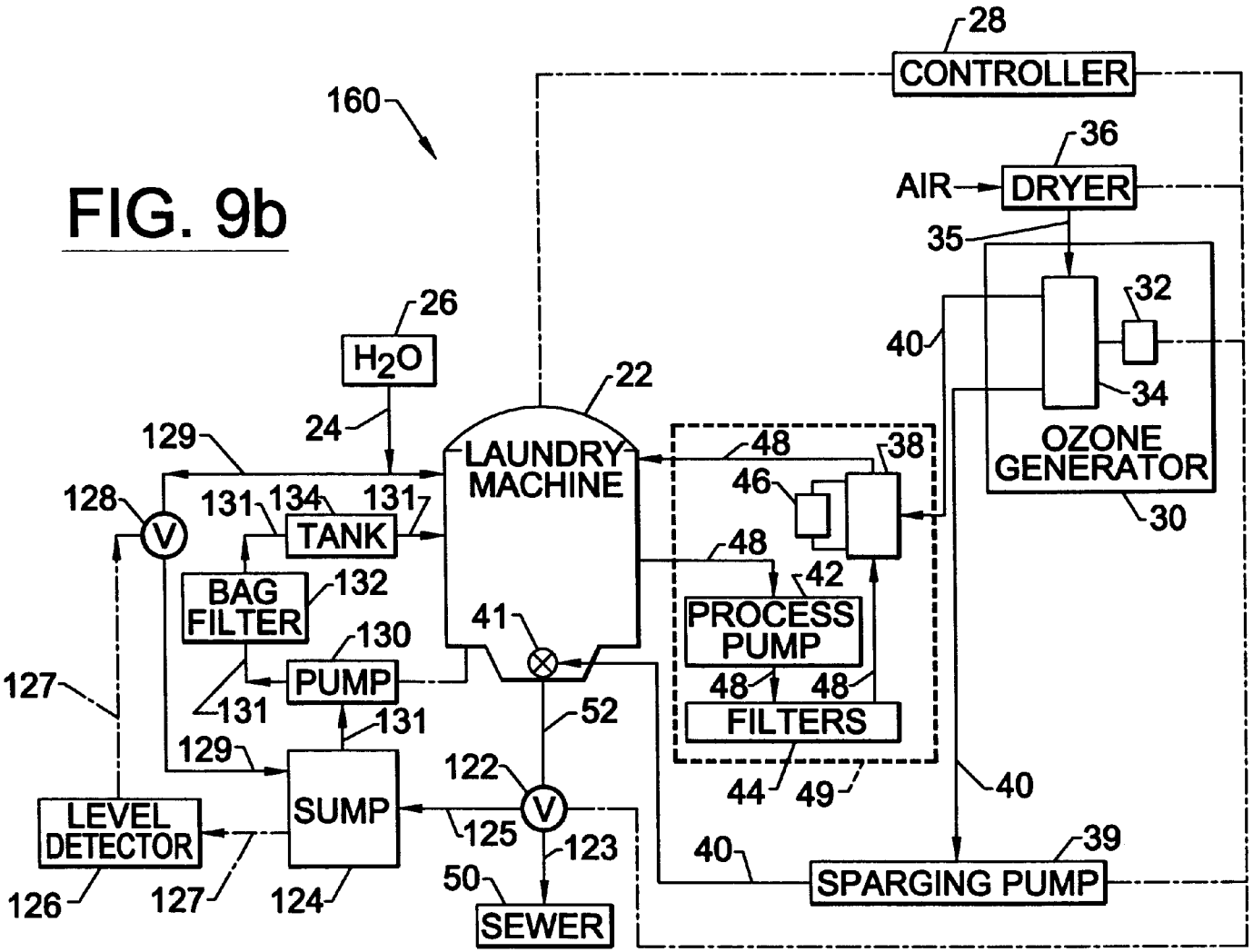
FIG. 9*b* is a schematic diagram of an alternative embodiment of an improved closed-loop, ozonated laundry system in accordance with the present invention including a side arm recirculation assembly.

Even further reductions in cost, energy and water consumption are available when the features of the present invention described herein are combined with a closed-loop, ozonated laundry system. FIG. 9*a* is a schematic diagram of a preferred embodiment of an improved closed-loop, ozonated laundry system 120 in accordance with the present invention. The closed-loop, ozonated laundry system 120 is identical to the open-loop, ozonated laundry system 20 illustrated in FIG. 2*a* with the capability to re-use at least a portion of the water utilized by the laundry machine 22 during the wash process. FIG. 9*b* is a schematic diagram of an alternative embodiment of an improved closed-loop, ozonated laundry system 160 in accordance with the present invention including a side arm recirculation assembly 49. The closed-loop, ozonated laundry system 160 is identical to the open-loop, ozonated laundry system 60 illustrated in FIG. 2*b* with the additional capability to re-use at least a portion of the water utilized by the laundry machine 22 during the wash process.

As shown in FIGS. 9*a* and 9*b*, the closed-loop, ozonated laundry systems 120, 160 each comprise a T-valve 122 positioned on the drain conduit 52 between the laundry machine 22 and the municipal sewer 50. The T-valve 122 selectively diverts the wastewater from the laundry machine 22 to the municipal sewer 50 through a sewer conduit 123 or to a conventional sump 124 through a sump conduit 125. Typically, the wastewater is diverted to the municipal sewer 50 after the first break cycle when the wash liquor has the highest concentration of wash chemistry and soil from the laundry. Because the wash liquor contains a high concentration of wash chemistry and soil, the wastewater from the laundry machine 22 after the first break cycle is referred to as the "dirty water." In response to the wash formula, the controller 28 sends a T-valve control signal to open the T-valve 122 to the sewer conduit 123. The dirty water is diverted to the municipal sewer 50 where it can be more effectively treated by the municipal sewer system. Typically, the wastewater from the laundry machine 22 is diverted to the sump 124 after each subsequent cycle of the wash process. In response to the wash formula, the controller 28 sends a T-valve control signal to open the T-valve 122 to the sump conduit 125. The wastewater is collected in the sump 124 and thereafter filtered and returned to the laundry machine 22 to be re-used in the wash process, as will be described hereafter.

In the event that the amount of wastewater in the sump 124 is insufficient to meet the requirements of the next cycle of the wash formula, supplemental water may be provided to the laundry machine 22 through the water supply conduit 24 directly from the municipal water source 26. Alternatively, the sump 124 may be provided with a level detector 126 in electrical communication with a one-way valve 128 through an electrical line 127. When the level of the wastewater in the sump 124 falls below a predetermined minimum, the level detector 126 sends an electrical signal along electrical line 127 to open the one-way valve 128, thereby permitting supplemental water to flow through a supplemental water supply conduit 129 to the sump 124. When the level of the wastewater in the sump 124 reaches a predetermined maximum, the level detector 126 sends an electrical signal along electrical line 127 to close the one-way valve 128, thereby preventing supplemental water from flowing through the supplemental water supply conduit 129 to the sump 124. Regardless, when the wash formula calls for the laundry machine 22 to receive water, the controller 28 sends a sump pump control signal to a conventional sump pump 130 to pump the wastewater from the sump 124 along wastewater conduit 131 to the laundry machine 22. The sump pump 130 draws the wastewater out of the sump 124 and into a conventional bag filter 132 for filtering particulate waste from the wastewater before it is provided to the laundry machine 22 through wastewater conduit 131. In addition, it may be necessary for a purpose to be described hereafter to provide a conventional retention tank 134 in fluid communication with the wastewater conduit 131 between the bag filter 132 and the laundry machine 22. The retention tank 134 retains a sufficient amount of filtered wastewater to be provided to one or more laundry machines 22 to meet the wash formula requirements for subsequent cycles of the wash process.

Figure 10:
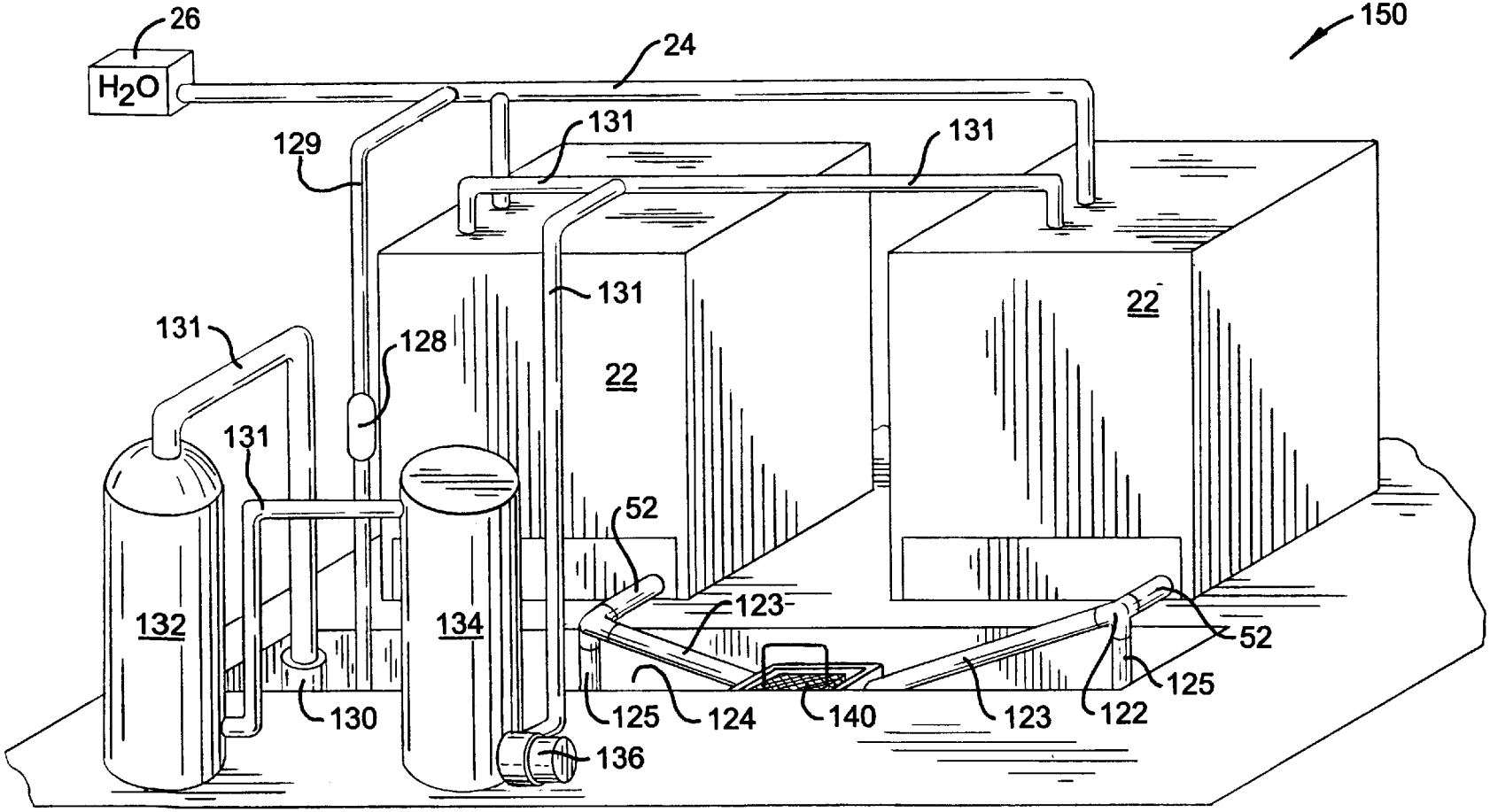
FIG. 10 is a front perspective view of a preferred embodiment of an improved closed-loop, ozonated laundry system in accordance with the present invention.
Figure 11:
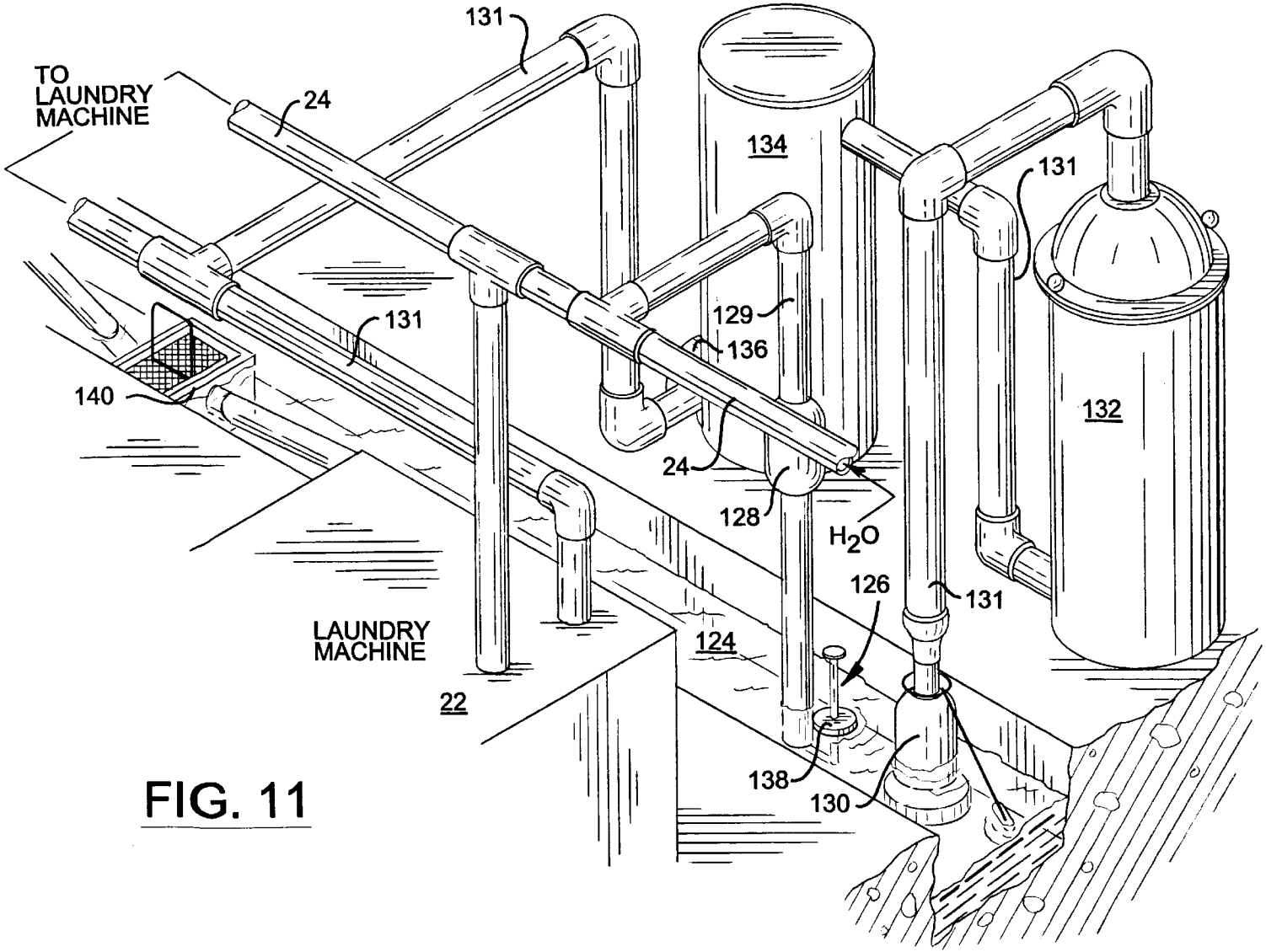
FIG. 11 is a rear perspective view of the improved closed-loop, ozonated laundry system of FIG. 10.
Figure 12:
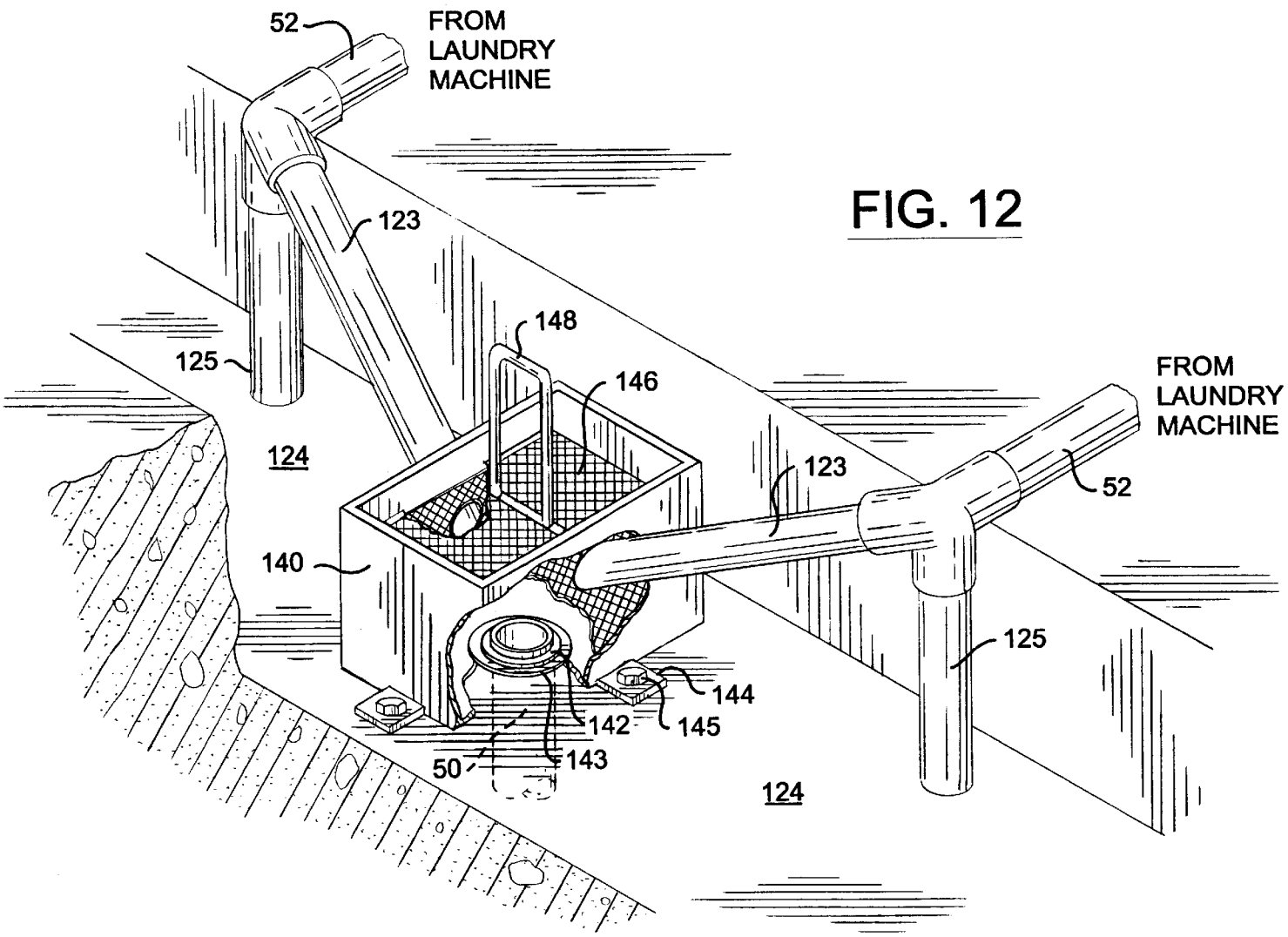
FIG. 12 is a front perspective view of a conventional sump modified for use with the improved closed-loop, ozonated laundry system of FIG. 10.

FIGS. 10–12 illustrate a preferred embodiment of an improved closed-loop, ozonated laundry system 150 in accordance with the present invention. As shown in FIG. 10, the closed-loop laundry system 150 comprises at least two laundry machines 22 coupled together by a common water supply conduit 24 from a municipal water source 26 and a common wastewater conduit 131. Each laundry machine 22 comprises a separate drain conduit 52 for draining the wastewater from the laundry machine to a T-valve 122 where the wastewater is diverted through a sewer conduit 123 directly to the municipal sewer system or through sump conduit 125 to a common sump 124. As best shown in FIG. 11, the closed-loop laundry system 150 further comprises a level detector 126 for detecting the amount of wastewater in the sump 124. The level detector 126 comprises a one-way valve 128, a float 138 and a supplemental water conduit 129 in fluid communication with the water conduit 24 from the municipal water source 26. When the float 138 of the level detector 126 falls below a predetermined minimum, the one-way valve 128 opens to permit water from the water conduit 24 to flow through the supplemental water conduit 129 into the sump 124. When the float 138 rises above a predetermined maximum, the one-way valve 128 closes to prevent water from the water conduit 24 from flowing through supplemental water conduit 129 into sump 124.

The closed-loop laundry system 150 further comprises a sump pump 130 having an inlet positioned adjacent the base of the sump 124 and a bag filter 132 in fluid communication with the sump pump through a wastewater conduit 131. The sump pump 130 pumps the wastewater from the sump 124 to the bag filter 132 to filter the particulate waste from the wastewater. Preferably, the bag filter 132 comprises one or more filters or filter screens to progressively eliminate smaller particles without impeding the flow of the wastewater. The filtered wastewater is then provided to the laundry machines 22 as required by their respective wash formulas. The closed-loop laundry system 150 may further comprise a retention tank 134 positioned along the wastewater conduit 131 between the bag filter 132 and the laundry machines 22 for temporarily retaining a predetermined amount of the filtered wastewater therein. The retention tank 134 preferably comprises a distribution pump 136 for pumping the filtered wastewater from the retention tank to the laundry machines 22. Alternatively, the sump pump 130 may be utilized to pump the filtered wastewater from the retention tank 134 to the laundry machines 22. The retention tank retains a sufficient amount of the filtered wastewater to fill the laundry machines 22 for the first cycle of the wash process and to meet the requirements of the wash formula in response to the particular wash load selection for each laundry machine.

As best shown in FIG. 12, the closed-loop laundry system 150 further comprises a hollow, non-porous drain basket 140. The drain basket 140 defines a cavity therein for collecting and filtering the dirty water from the first break cycle of the wash process that is diverted directly to the sewer 50 through sewer conduit 123. The drain basket 140 comprises a base opposite the floor of the sump 124 and a continuous sidewall depending upwardly from the base. A wax drain seal 142 provides a fluid-tight connection between the drain basket 140 and the sewer 50 and a plurality of attachment feet 144 are provided on the base for securely attaching the drain basket to the floor of the sump 124. The sidewall of the drain basket 140 has a pair of laterally opposed holes formed therethrough for receiving the sewer conduits 123 from the laundry machines 22 therein. The base of the drain basket 140 has a large diameter drain hole formed therethrough for receiving the drain pipe from the sewer 50 therein. The drain basket 140 is positioned over the drain pipe from the sewer 50 and the wax drain seal 142 is positioned between the base of the drain basket and a collar 143 provided on the drain pipe from the sewer. Each of the attachment feet 144 of the drain basket 140 has a hole formed therethrough for receiving a fastener 145 therein to securely attach the drain basket to the floor of the sump 124.

The drain basket 140 further comprises a hollow, removable strainer 146 for filtering particulate waste from the dirty water. Preferably, the strainer 146 is made of a rigid, porous mesh material, such as aluminum wire. Alternatively, the strainer may be made of a flexible, porous mesh material, such as nylon or other suitable polymer. Regardless, the strainer 146 is removably placed within the cavity defined by the drain basket 140. The strainer 146 is provided with a handle 148 for removing the strainer from the drain basket 140 to clean the strainer. Accordingly, the dirty water from the laundry machines 22 collects in the cavity defined by the drain basket 140 and thereafter drains through the mesh material of the porous strainer 146 and into the drain pipe from the sewer 50. The volumetric capacity of the drain basket 140 is sized such that the flow rate through the strainer 146 permits the dirty water from the laundry machines 22 to drain into the sewer 50 without overflowing into the sump 124 even if the strainer is as much as about 50% clogged. Preferably, a warning system is also provided to alert the operator that the strainer 146 should be cleaned before the next dirty water cycle of the laundry machines 22. However, as a further precaution, the depth of the drain basket 140 is such that the dirty water will spill into the sump 124 rather than onto the floor surrounding the laundry machines 22 if the dirty water overflows the drain basket.

Figure 13:
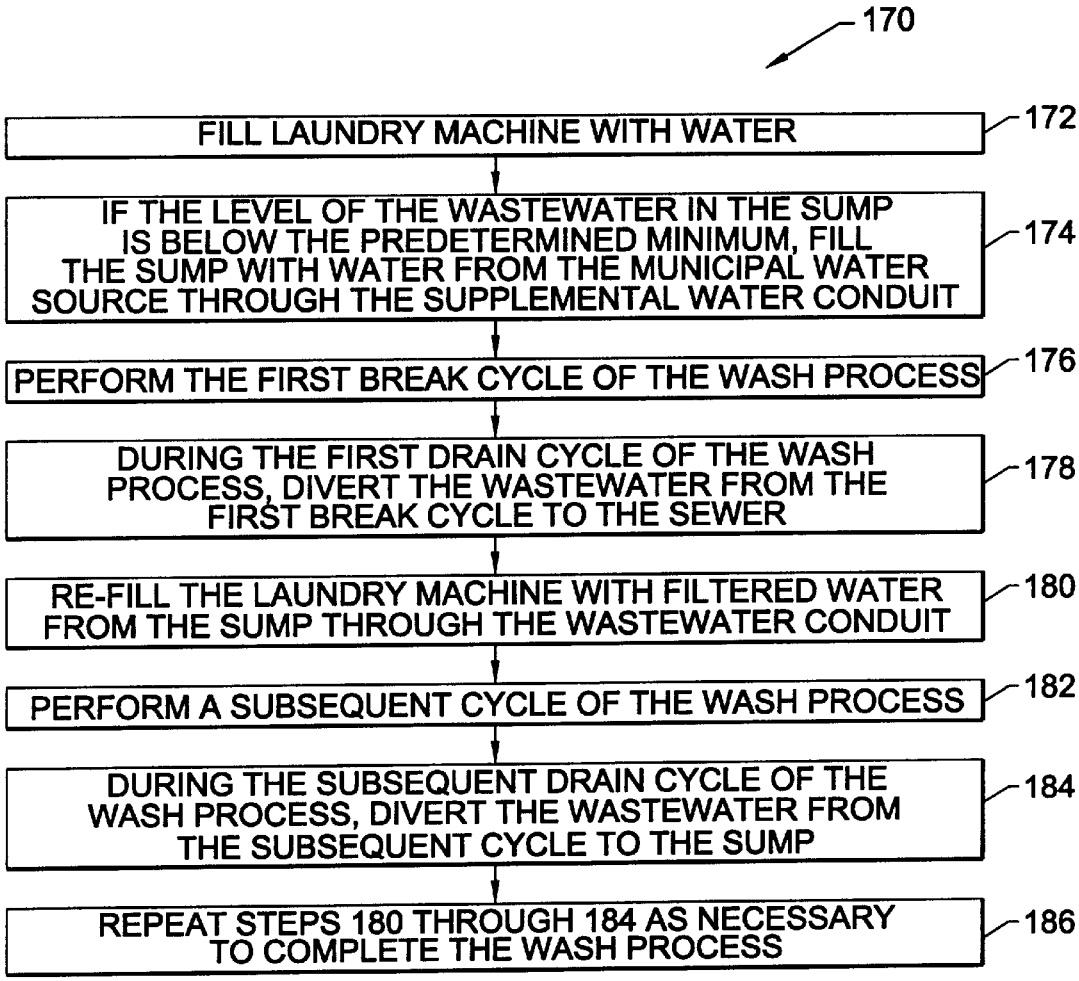
FIG. 13 is a flowchart of a preferred method in accordance with the present invention including the capability to re-use at least a portion of the water utilized by the laundry machine during the wash process.

A preferred method 170 of operating the closed-loop laundry system 150 is illustrated in FIG. 13. The method 170 further reduces the amount of energy and water consumed during the wash process by re-using at least a portion of the water from the municipal water supply utilized by the laundry machine 22 during the wash process. The method 170 comprises the first step 172 of filling a laundry machine 22 with water from the municipal water source 26 through water conduit 24 or, if available, from the sump 124 through wastewater conduit 131. If the level of the wastewater in the sump 124 is below the predetermined minimum, the method comprises the second step 174 of filling the sump 124 with water from the municipal water source 26 through the supplemental water conduit 129. The method 170 comprises the third step 176 of performing the first break cycle of the wash process. The method 170 comprises the fourth step 178 of diverting the wastewater from the laundry machine 22 to a sewer 50 during the first drain cycle of the wash process after completion of the first break cycle. The method 170 comprises the fifth step 180 of re-filling the laundry machine 22 with filtered water from the sump 124 through wastewater conduit 131. The method 170 comprises the sixth step 182 of performing a subsequent cycle of the wash process. The method 170 comprises the seventh step 184 of diverting the wastewater from the laundry machine 22 to the sump 124 during the subsequent drain cycle of the wash process. Finally, the method 170 comprises the eighth step 186 of repeating steps 180 through 184 as necessary to complete the wash process.

From the foregoing detailed description, it is readily apparent that a system and method for treating laundry with ozone that varies the concentration of the ozone in the wash liquor is provided. The system and method varies the concentration of ozone dispersed, or dispersed and/or entrained, into the wash liquor in response to a predetermined wash load. The present invention also provides a system and method for treating laundry with ozone that balances the wash chemistry with the concentration of ozone dispersed, or dispersed and/or entrained, into the wash liquor. Accordingly, the present invention provides a system and method for treating laundry with ozone that introduces an efficient amount of ozone and wash chemistry into the wash liquor in response to the type of laundry load to minimize ozone off-gassing, and to conserve energy and water. The present invention further provides a system for treating laundry with ozone including an adapter for removably securing the ozone injector adjacent the drain of the laundry machine. Accordingly, the ozone injector is easily accessible and can be readily removed for cleaning, repair or replacement. Finally, the present invention provides an ozonated laundry system and method that includes the capability to re-use at least a portion of the water utilized by the laundry machine during the wash process.

It is to be understood that the foregoing description and specific embodiments are merely illustrative of the best mode of the invention and the principles thereof, and that various modifications may be made to the ozonated laundry systems or methods disclosed herein by those skilled in the art without departing from the spirit and scope of the invention, which is therefore understood to be limited only by the scope of the appended claims. In particular, the scope of the invention is not limited to a system and method for treating laundry with ozone which utilizes a commercial or institutional automated laundry installation, or a conventional washing machine equipped with an automated detergent dispenser or otherwise adapted to accept a wash formula from a controller.

That which is claimed is:

1. A system for treating laundry with ozone including the capability to re-use at least a portion of the water utilized during the wash process, said system comprising a laundry machine defining a cavity therein for receiving a wash liquor comprising water from a municipal water source, said laundry machine comprising a drain for draining the wash liquor from the cavity and a means for selecting a wash load from a predetermined plurality of wash load selections;

a controller in electrical communication with said selecting means, said controller receiving a load signal from said selecting means and transmitting a control signal corresponding to the wash load;

an ozone generator in electrical communication with said controller, said ozone generator receiving the control signal from said controller and generating a variable amount of ozone in response to the control signal;

an air dryer in electrical communication with said controller and in fluid communication with said ozone generator, said air dryer providing desiccated air to said ozone generator;

a sparging pump in electrical communication with said controller and in fluid communication with said ozone generator, said sparging pump pumping the ozone generated by said ozone generator from said ozone generator to said laundry machine;

an injector assembly in fluid communication with said sparging pump and said laundry machine, said injector assembly positioned adjacent said drain of said laundry machine for dispersing the variable amount of ozone generated by the ozone generator in response to the control signal directly into the wash liquor in the cavity defined by said laundry machine;

a sump in fluid communication with said laundry machine;

a sewer in fluid communication with said laundry machine;

a T-valve in fluid communication with and positioned between said sump and said laundry machine and in fluid communication with and positioned between said sewer and said laundry machine, said T-valve selectively diverting wastewater from the cavity defined by said laundry machine to said sump and to said sewer;

a sump pump in fluid communication with and positioned between said sump and said laundry machine, said sump pump pumping the wastewater diverted to said sump to the cavity defined by said laundry machine; and a bag filter in fluid communication with and positioned between said sump pump and said laundry machine for filtering the wastewater pumped to the cavity defined by said laundry machine.

2. The system of claim 1 further comprising a retention tank in fluid communication with and positioned between said bag filter and said laundry machine, said retention tank retaining a portion of the wastewater filtered by said bag filter; and a distribution pump in fluid communication with and positioned between said retention tank and said laundry machine, said distribution pump pumping the wastewater filtered by said bag filter to said laundry machine.

3. The system of claim 1 further comprising a level detector for detecting the level of the wastewater in said sump, said level detector comprising a one-way valve in fluid communication with and positioned between the municipal water source and said sump, said one-way valve selectively diverting water from the municipal water source to said sump when the level of the wastewater in said sump falls below a predetermined minimum.

4. The system of claim 1 further comprising a hollow, non-porous drain basket defining a cavity therein, said drain basket in fluid communication with and positioned between said T-valve and said sewer, said drain basket comprising a base and a continuous sidewall depending upwardly from said base, said sidewall having at least one lateral hole formed therethrough for receiving a conduit therein extending between said T-valve and said drain basket, said base having at least one drain hole formed therethrough for receiving a drain pipe therein extending from said sewer; and a hollow, porous strainer removably placed within the cavity defined by said drain basket for filtering particulate waste from the wastewater diverted to said sewer.

5. A method for treating laundry with ozone including the capability to re-use at least a portion of the water utilized during the wash process in a laundry machine defining a cavity therein for receiving a predetermined wash liquor comprising water from a municipal water source and a drain for draining the wash liquor from the cavity, said method comprising the steps of (a) selecting a wash load from a predetermined plurality of wash load selections;

(b) initiating a wash formula corresponding to the wash load and a drain cycle counter;

(c) transmitting a load signal from a controller to introduce the predetermined wash liquor into the cavity defined by the laundry machine;

(d) transmitting a load signal from the controller to vary the amount of ozone generated by an ozone generator;

(e) using an ozone injector to disperse the ozone generated by the ozone generator directly into the wash liquor in the cavity defined by the laundry machine;

(f) performing the first break cycle of the wash formula;

(g) during the first drain cycle of the wash formula, diverting the dirty water from the cavity defined by the laundry machine directly into a sewer through a sewer conduit;

(h) re-filling the cavity defined by the laundry machine with filtered wastewater from a sump through a wastewater conduit;

(i) performing a subsequent cycle of the wash formula;

(j) during the subsequent cycle of the wash formula, diverting the wastewater from the cavity defined by the laundry machine directly into the sump through a sump conduit; and (k) repeating steps (h) through (j) as necessary to complete the wash formula.

6. The method of claim 5 wherein the step (h) comprises the further steps of (h1) determining whether the level of the wastewater in the sump is below a predetermined minimum;

(h2) filling the sump with water from a municipal water source as necessary until the level of the wastewater in the sump reaches the predetermined minimum.

7. The system of claim 1 wherein said injector assembly comprises an ozone injector and an adapter for removably securing said ozone injector to the exterior surface of the wall of said laundry machine adjacent said drain.

8. The system of claim 7 wherein said ozone injector is selected from the group consisting of an ozone diffuser stone and a sparging rod.

9. The system of claim 1 wherein said ozone generator comprises a power supply for receiving the control signal from said controller and for producing a variable output potential; and an ozonator in electrical communication with said variable power supply for ionizing the desiccated air provided to said ozone generator by said air dryer in response to the output potential.

10. The system of claim 1 further comprising a side arm recirculation assembly for entraining ozone generated by said ozone generator into the wash liquor, said side arm recirculation assembly comprising a process pump in electrical communication with said controller and in fluid communication with said laundry machine;

a filter in fluid communication with said process pump for removing particulate waste from the wash liquor; and an ozone entrainer in fluid communication with said ozone generator and said filter;

wherein said process pump draws the wash liquor from the cavity defined by said laundry machine past said filter to said ozone entrainer and returns the wash liquor to the cavity defined by said laundry machine.

11. The system of claim 10 further comprising a flow valve in fluid communication with said ozone entrainer for maintaining a predetermined flow rate of the wash liquor past said filter and said ozone entrainer.

* * * * *